US008978551B2

(12) United States Patent
Miller

(10) Patent No.: US 8,978,551 B2
(45) Date of Patent: Mar. 17, 2015

(54) PROJECTION ASSISTED PRINTER ALIGNMENT USING REMOTE DEVICE

(75) Inventor: Todd W. Miller, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 168 days.

(21) Appl. No.: 13/557,963

(22) Filed: Jul. 25, 2012

(65) Prior Publication Data

US 2014/0026769 A1 Jan. 30, 2014

(51) Int. Cl.

| | |
|---|---|
| ***B41F 17/00*** | (2006.01) |
| ***B41F 1/34*** | (2006.01) |
| ***B41J 3/28*** | (2006.01) |
| ***B41J 3/407*** | (2006.01) |
| ***B41J 3/46*** | (2006.01) |

(52) U.S. Cl.

CPC ..... *B41F 17/006* (2013.01); *B41J 3/28* (2013.01); *B41J 3/4073* (2013.01); *B41J 3/46* (2013.01)

USPC ..... 101/35; 101/485

(58) Field of Classification Search

CPC ..... B41F 17/24; B41F 17/34; B41F 17/38

USPC ..... 101/35, 41, 44, 484, 485; 347/4, 5, 104, 347/108

See application file for complete search history.

(56) References Cited

U.S. PATENT DOCUMENTS

| | | | | |
|---|---|---|---|---|
| 4,124,285 | A | 11/1978 | Johnson et al. | |
| 5,040,913 | A | 8/1991 | Folkens et al. | |
| 5,168,294 | A | 12/1992 | Davis et al. | |
| 5,195,451 | A | 3/1993 | Nakashima | |
| 5,588,216 | A | 12/1996 | Rank et al. | |
| 5,646,859 | A | 7/1997 | Petta et al. | |
| 6,161,491 | A | 12/2000 | Takenoya et al. | |
| 6,336,694 | B1 | 1/2002 | Ishizaka | |
| 6,376,148 | B1 * | 4/2002 | Liu et al. | 430/124.4 |
| 6,793,352 | B2 | 9/2004 | Karasawa et al. | |
| 7,241,981 | B2 | 7/2007 | Hofmann | |
| 7,526,997 | B2 * | 5/2009 | Davidson | 101/35 |
| 7,987,779 | B2 * | 8/2011 | Wang | 101/35 |
| 8,022,997 | B2 | 9/2011 | Shingu et al. | |
| 2002/0080332 | A1 | 6/2002 | Jones et al. | |
| 2005/0022686 | A1 | 2/2005 | Wessells et al. | |
| 2006/0221403 | A1 | 10/2006 | Bancel | |

(Continued)

FOREIGN PATENT DOCUMENTS

| | | |
|---|---|---|
| DE | 3938663 | 5/1991 |
| EP | 331108 | 9/1989 |

(Continued)

OTHER PUBLICATIONS

International Search Report and Written Opinion mailed Nov. 15, 2013 in International Application No. PCT/US2013/051765.

(Continued)

*Primary Examiner* — Ren Yan

(74) *Attorney, Agent, or Firm* — Plumsea Law Group, LLC

(57) ABSTRACT

A flexible manufacturing system includes a printing system, a projection system and a remote device. The projection system is calibrated with the printing system and helps with aligning graphics to be printed on an article. The remote device receives information from an optical device corresponding to a projection area of the projection system. The remote device can be used to control the alignment of a projected graphic on the article when the article is inside the projection area.

20 Claims, 24 Drawing Sheets

(56) References Cited

U.S. PATENT DOCUMENTS

| | | | | |
|---|---|---|---|---|
| 2008/0144053 | A1 | 6/2008 | Gudan et al. | |
| 2008/0273175 | A1 | 11/2008 | Gallucci | |
| 2011/0109686 | A1 | 5/2011 | McDowell et al. | |
| 2012/0008101 | A1 | 1/2012 | Oka | |
| 2012/0019511 | A1 | 1/2012 | Chandrasekhar | |
| 2012/0069150 | A1 | 3/2012 | Rivera | |
| 2012/0103210 | A1* | 5/2012 | Hashimoto | 101/35 |

FOREIGN PATENT DOCUMENTS

| | | |
|---|---|---|
| EP | 0401841 | 12/1990 |
| EP | 2641661 | 9/2013 |
| JP | H05293955 | 11/1993 |
| JP | 2005004089 | 1/2005 |
| JP | 2006139222 | 6/2006 |
| JP | 2011039216 | 2/2011 |
| WO | 9626838 | 9/1996 |
| WO | 2012038446 | 3/2012 |

OTHER PUBLICATIONS

International Search Report and Written Opinion mailed Nov. 22, 2013 in International Application No. PCT/US2013/051766.

* cited by examiner

PROJECTION ASSISTED PRINTER ALIGNMENT USING REMOTE DEVICE

This application is related to U.S. Patent Application Publication Number 2014/0026773, U.S. patent application No. 13/557,935 filed Jul. 25, 2012 and titled "Projector Assisted Alignment and Printing," the entirety of which is hereby incorporated by reference.

BACKGROUND

The present embodiments relate generally to articles of footwear and in particular to a flexible manufacturing system for an article of footwear.

SUMMARY

In one aspect, a method of customizing an article includes associating the article with a projection system, projecting a graphic onto the article using the projection system and capturing image information associated with the graphic and the article. The method further includes displaying the image information on a remote device, receiving alignment information from the remote device and adjusting the alignment of the graphic on the article according to the alignment information so that the graphic is disposed in a predetermined portion of the article. The method further includes associating the article with a printing system and printing a printed graphic on the article on the predetermined portion of the article.

In another aspect, a flexible manufacturing system for an article includes a printing system and a projection system that is calibrated with the printing system, where the projection system can be used to align a graphic that is to be printed onto the article by the printing system. The flexible manufacturing system also includes a projection area for receiving a graphic and an optical device for capturing image information associated with the projection area. The flexible manufacturing system also includes a remote device configured to display the image information and the remote device can be used to control the alignment of the graphic within the projection area.

In another aspect, a flexible manufacturing system includes a first station including: a first printing system and a first projection system, where the first projection system is calibrated with the first printing system so as to assist with printing alignment; a first projection area for projecting a first graphic onto a first article using the first projection system and a second station including: a second printing system and a second projection system, wherein the second projection system is calibrated with the second printing system so as to assist with printing alignment; a second projection area for projecting a second graphic onto a second article using the second projection system. The flexible manufacturing system also includes a remote device configured to receive: first image information corresponding to the first projection area and second image information corresponding to the second projection area. The remote device can be used to control the alignment of the first graphic on the first article and the remote device can be used to control the alignment of the second graphic on the second article.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
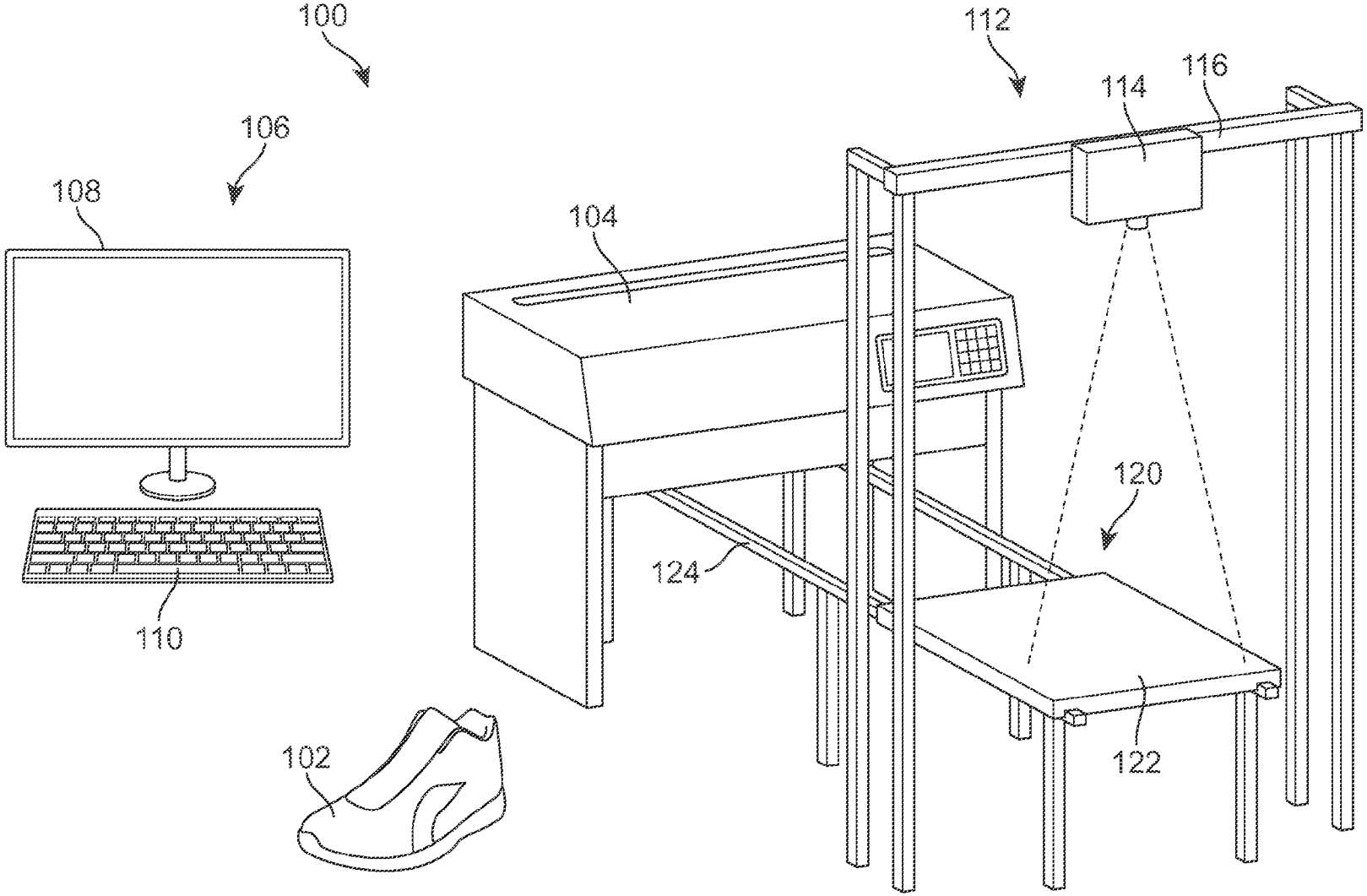
FIG. 1 is a schematic view of an embodiment of a flexible manufacturing system.

FIG. 1 is a schematic view of an embodiment of flexible manufacturing system 100. In some embodiments, flexible manufacturing system 100 may be intended for use with various kinds of articles including footwear and/or apparel. In particular, flexible manufacturing system 100 may include various kinds of provisions for applying graphics, or any type of design or image, to footwear and/or apparel. Moreover, the process of applying graphics may occur after an article has been manufactured. For example, graphics may be applied to an article of footwear after the article of footwear has been manufactured into a three-dimensional form including an upper and sole structure.

The term "graphic" as used throughout this detailed description and in the claims refers to any visual design elements including, but not limited to: photos, logos, text, illustrations, lines, shapes, images of various kinds as well as any combinations of these elements. Moreover, the term graphic is not intended to be limiting and could incorporate any number of contiguous or non-contiguous visual features. For example, in one embodiment, a graphic may comprise a logo that is applied to a small region of an article of footwear. In another embodiment, a graphic may comprise a large region of color that is applied over one or more regions of an article of footwear.

For clarity, the following detailed description discusses an exemplary embodiment, in which flexible manufacturing system 100 is used to apply graphics to article of footwear 102. In this case, article of footwear 102, or simply article 102, may take the form of an athletic shoe, such as a running shoe. However, it should be noted that the other embodiments could be used with any other kinds footwear including, but not limited to: hiking boots, soccer shoes, football shoes, sneakers, rugby shoes, basketball shoes, baseball shoes as well as other kinds of shoes. While FIG. 1 shows a single article, it will be understood that flexible manufacturing system 100 could be used to apply graphics to two or more articles, including articles that make up a pair of footwear.

Flexible manufacturing system 100 need not be limited to use with articles of footwear and the principles taught throughout this detailed description may be applied to additional articles as well. Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to: footwear, gloves, shirts, pants, socks, scarves, hats, jackets, as well as other articles. Other examples of articles include, but are not limited to: shin guards, knee pads, elbow pads, shoulder pads, as well as any other type of protective equipment. Additionally, in some embodiments, the article could be another type of article that is not configured to be worn, including, but not limited to: balls, bags, purses, backpacks, as well as other articles that may not be worn.

Flexible manufacturing system 100 may comprise various provisions that are useful in applying a graphic directly to an article. In some embodiments, flexible manufacturing system 100 may include printing system 104. Printing system 104 may comprise one or more individual printers. Although a single printer is illustrated in FIG. 1, other embodiments could incorporate two or more printers that may be networked together.

Printing system 104 may utilize various types of printing techniques. These can include, but are not limited to: toner-based printing, liquid inkjet printing, solid ink printing, dye-sublimation printing, inkless printing (including thermal printing and UV printing), MEMS jet printing technologies as well as any other methods of printing. In some cases, printing system 104 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements.

In one embodiment, printing system 104 may utilize an inkjet printer in which ink droplets may be sprayed onto a substrate, such as the medial or lateral side panel of a formed upper. Using an inkjet printer allows for easy variation in color and ink density. This arrangement also allows for some separation between the printer head and the target object, which can facilitate printing directly to objects with some curvature and/or surface texture.

Flexible manufacturing system 100 can include provisions for facilitating the alignment of a printed graphic onto article 102. In some embodiments, it may be useful to provide a user with a way of aligning an article with a printing system so as to ensure a graphic is printed in the desired portion of the article. In particular, flexible manufacturing system 100 may include provisions for pre-aligning an article with a printer in such a way as to accommodate articles of various types, shapes and sizes.

In some embodiments, flexible manufacturing system 100 may include alignment system 112. Alignment system 112 may be seen to further comprise a projection system 114 and a transfer system 120. In some embodiments, projection system 114 comprises one or more projectors that are capable of displaying images onto one or more portions of an article. Although a single projector is shown in the current embodiment, other embodiments may include two or more projectors. In embodiments where two or more projectors are used, the projectors may operate cooperatively or independently to display one or more graphics onto the surface of an article. Furthermore, as discussed in further detail below, a projection system could incorporate additional provisions including, for example, mirrors, various kinds of lenses, screens for displaying images as well as any other provisions that may be required to generate and display a projected image.

Various kinds of projectors can be used and it will be understood that projection system 114 is not limited to a particular kind of projection technology. Examples of different projector technologies that can be used with projection system 114 include, but are not limited to: CRT projection, LCD projection, DLP projection, LCoS projection, LED projection, Hybrid LED projection, Laser diode projection as well as any other kinds of projection technologies. The type of projection technology used may be selected according to various factors including ease of use, compatibility with other systems, visual clarity of the displayed image on the surface of an article as well as any other factors or constraints associated with the operation of flexible manufacturing system 100.

Some embodiments can include provisions for supporting projection system 114. In some embodiments, support frame 116 is provided. Support frame 116 may comprise any kind of frame and may further include provisions for temporarily fixing the position of projection system 114 in place with respect to flexible manufacturing system 100. In some cases, support frame 116 includes features that allow the position of projection system 114 to be easily adjusted. In particular, some embodiments may allow the position of projection system 114 to be changed in horizontal and vertical directions. This could be accomplished in some cases by adjusting the position of support frame 116 and/or by adjusting the location to which projection system 114 is attached to support frame 116. Although the attachment of projection system 114 to support frame 116 is shown schematically in this embodiment, other embodiments could utilize any type of mounting systems for permanently or adjustable mounting projection system 114 to support frame 116.

Transfer system 120 may comprise one or more cooperating systems that facilitate the movement of an article between printing system 104 and projection system 114. In some embodiments, transfer system 120 may be designed so that once a projected graphic has been aligned in the desired location on an article, the article can be transferred to printing system 104 in a manner that maintains the desired alignment. Details of this alignment method are discussed in further detail below.

In one embodiment, transfer system 120 can include platform 122 and tracks 124. In some embodiments, platform 122 is a generally planar structure that is adapted to hold one or more articles of footwear and/or other kinds of apparel. Specifically, platform 122 may be large enough to accommodate at least one article of footwear such that the article of footwear can be moved to different locations of platform 122.

In some embodiments, tracks 124 are adapted to guide platform 122 between at least two predetermined positions associated with printing system 104 and projection system 114, respectively. In FIG. 1, tracks 124 are illustrated as being independently supported, however other embodiments could utilize a supporting table to which tracks 124 are mounted.

With platform 122 mounted to tracks 124 in a slidable manner, platform 122 may be easily adjusted between a first, or display ready, position and a second, or print ready, position. Moreover, some embodiments can include provisions for temporarily locking the position of platform 122 in the first position and/or second position. By transferring an article between projection system 114 and printing system 104 using transfer system 120, the orientation and relative position of the article can be held constant, as discussed in further detail below.

The current embodiment illustrates a transfer system 120 that can be operated manually by a user. However, it is contemplated that other embodiments could incorporate provisions for automating the operation of transfer system 120. For example, some embodiments could include motors and/or other provisions for automatically driving platform 122 to various positions along tracks 124. Moreover, in such automated embodiments, the position and/or speed of platform 122 could be adjusted using controls provided at transfer system 120 or using an associated system, such as computing system 106 which is discussed in further detail below.

In some embodiments, platform 122 may be specifically adapted to secure an article in a fixed position or orientation. For example, some embodiments may include various kinds of mounting devices, harnesses or other provisions that may temporarily fix or hold the position of an article relative to platform 122. Such provisions may help precisely orient a specific portion of an article towards a projector (and correspondingly towards a printer). For example, some embodiments could utilize a harness that fixes the orientation and position of an article on platform 122 so that a projected graphic can be projected onto any desired portion of the article of footwear. These provisions may also reduce the tendency of an article to move or jostle as the position of platform 122 is adjusted.

Flexible manufacturing system 100 may include provisions for supplying printing system 104 and/or projection system 114 with one or more graphics. In some embodiments, flexible manufacturing system 100 may include computing system 106. The term "computing system" refers to the computing resources of a single computer, a portion of the computing resources of a single computer, and/or two or more computers in communication with one another. Any of these resources can be operated by one or more users. In some cases, computing system 106 can include user input device 110 that allow a user to interact with computing system 106. Likewise, computing system 106 may include display 108. Moreover, computing system 106 can include additional provisions, such as a data storage device (not shown). A data storage device could include various means for storing data including, but not limited to: magnetic, optical, magneto-optical, and/or memory, including volatile memory and non-volatile memory. These provisions for computing system 106, as well as possibly other provisions not shown or described here, allow computing system 106 to facilitate the creation, storage and export of graphics to any or all of the devices and systems described here and shown in FIG. 1.

For purposes of facilitating communication between printing system 104, computing system 106, and/or projection system 114, these systems can be connected using a network of some kind. Examples of networks include, but are not limited to: local area networks (LANs), networks utilizing the Bluetooth protocol, packet switched networks (such as the Internet), various kinds of wired networks, wireless networks as well as any other kinds of networks. In other embodiments, rather than utilizing an external network, printing system 104 and/or projection system 114 could be connected directly to computing system 106, for example, as peripheral hardware devices.

Figure 2:
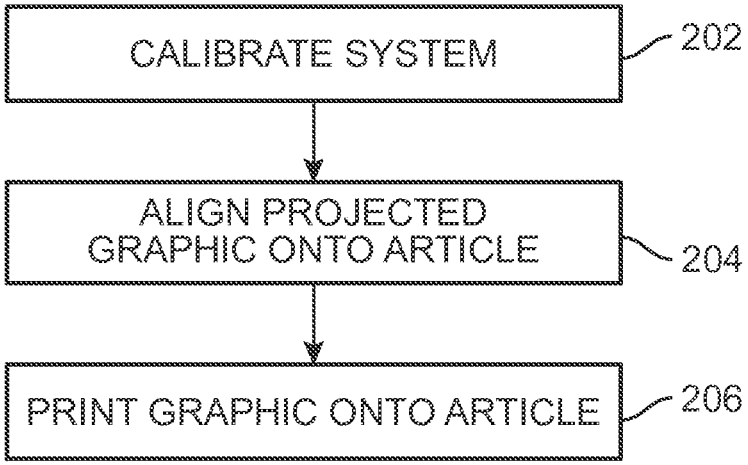
FIG. 2 is a schematic view of a process for customizing an article according to one embodiment.

FIG. 2 illustrates a process for adding a graphic to an article using flexible manufacturing system 100 described above. It will be understood that some embodiments could include additional steps not discuss here. In other embodiments one or more of the following steps may be optional. Furthermore, in some cases some of the following steps could be accomplished by different systems and/or users. For example, in some embodiments a calibration step may be performed by a first operator of the system, while alignment and printing could be performed by a second operator of the system.

During step 202, one or more calibration processes may be performed. In some embodiments, projection system 114 may be calibrated with printing system 104, relative to platform 122. In particular, projection system 114 may be calibrated in a manner so that the relative positions and orientations of graphics displayed onto platform 122 correspond substantially identically to the relative positions and orientations of graphics that are printed onto a substrate (such as paper) lying directly over platform 122.

Next, during step 204, a projected graphic is displayed on an article residing on platform 122. In this step, the relative position of the projected graphic on the article may be adjusted. In some cases, this could be achieved by moving the position and orientation of the article on platform 122 while keeping the position of the projected graphic fixed. In other cases, this could be achieved by adjusting the position of the projected graphic while keeping the position of the article fixed. Thus, for example, if the projected graphic is displayed at the heel of the article, but the user wants the graphic on the forefoot, the projected graphic can be moved until the projected graphic is aligned with the desired region of the article.

Finally, during step 206, once the display graphic has been properly aligned with the article, the article may be moved to the printing system 104. At this point, a printed graphic corresponding to the projected graphic can be printed onto the desired region of the article.

Flexible manufacturing system 100 may include provisions to calibrate one or more components. In some embodiments, flexible manufacturing system 100 can include provisions that calibrate the operation of printing system 104 and projection system 114. In particular, in some cases, projection system 114 may be calibrated so that the alignment of a projected graphic on an article using projection system 114 corresponds to a similar alignment of a printed graphic on the article using printing system 104. The term "projected graphic" as used throughout this detailed description and in the claims refers to any graphic that is produced by projection system 114. Furthermore, the term "printed graphic" as used throughout this detailed description and in the claims refers to any graphic that is produced by printing system 104.

Figure 3:
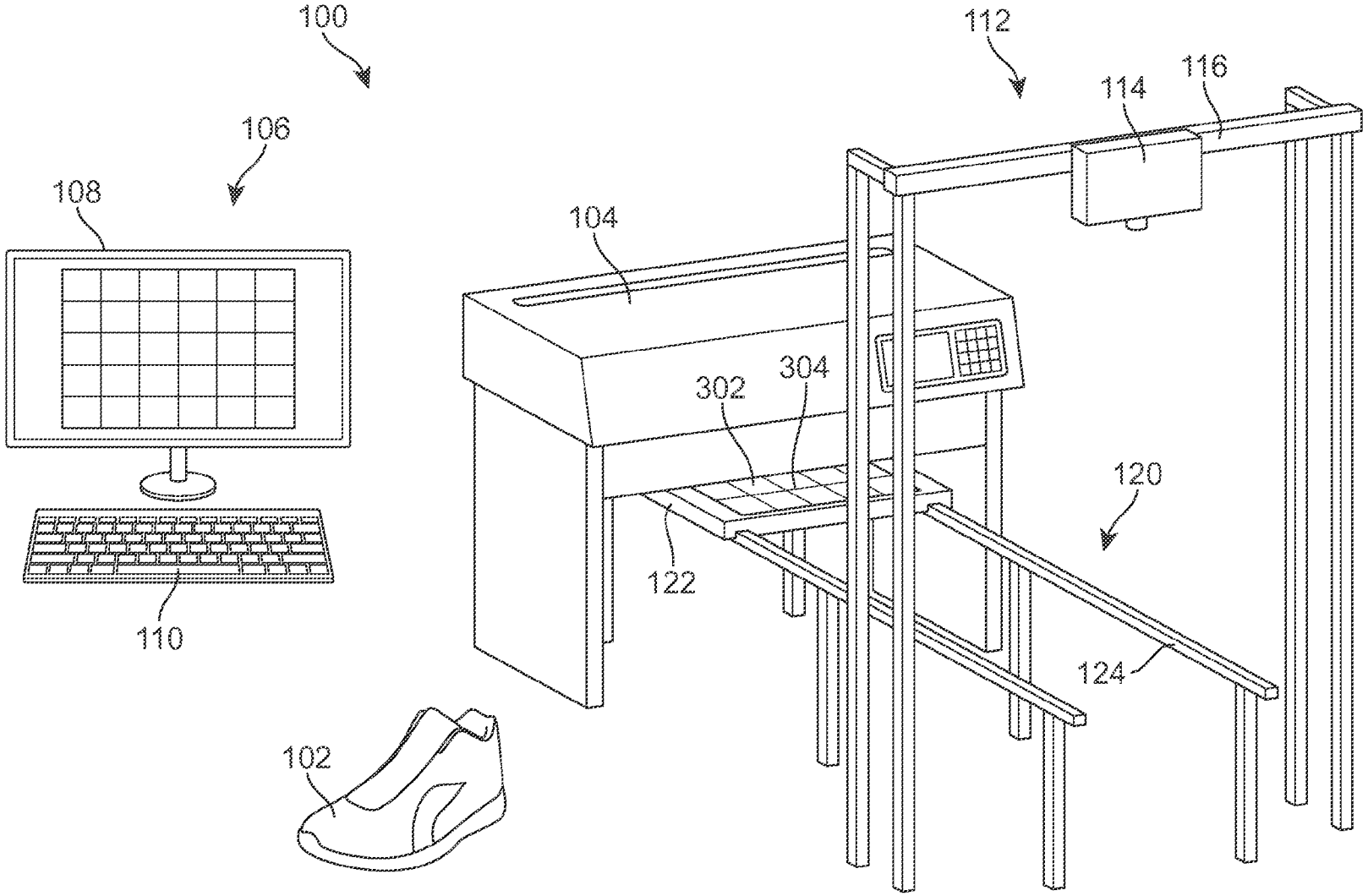
FIG. 3 is a schematic view of an embodiment of a flexible manufacturing system, including a step of printing a test grid.

Referring to FIG. 3, the calibration process starts when a printed graphic is printed to sheet 302. In this case, test grid 304 is printed onto sheet 302. Test grid 304 may comprise horizontal and vertical lines. The spacing, thickness and any other properties of these lines could be varied in different embodiments. Although the current embodiment uses a test grid, other embodiments could use any other kind of testing graphic, including any other pattern.

Figure 4:
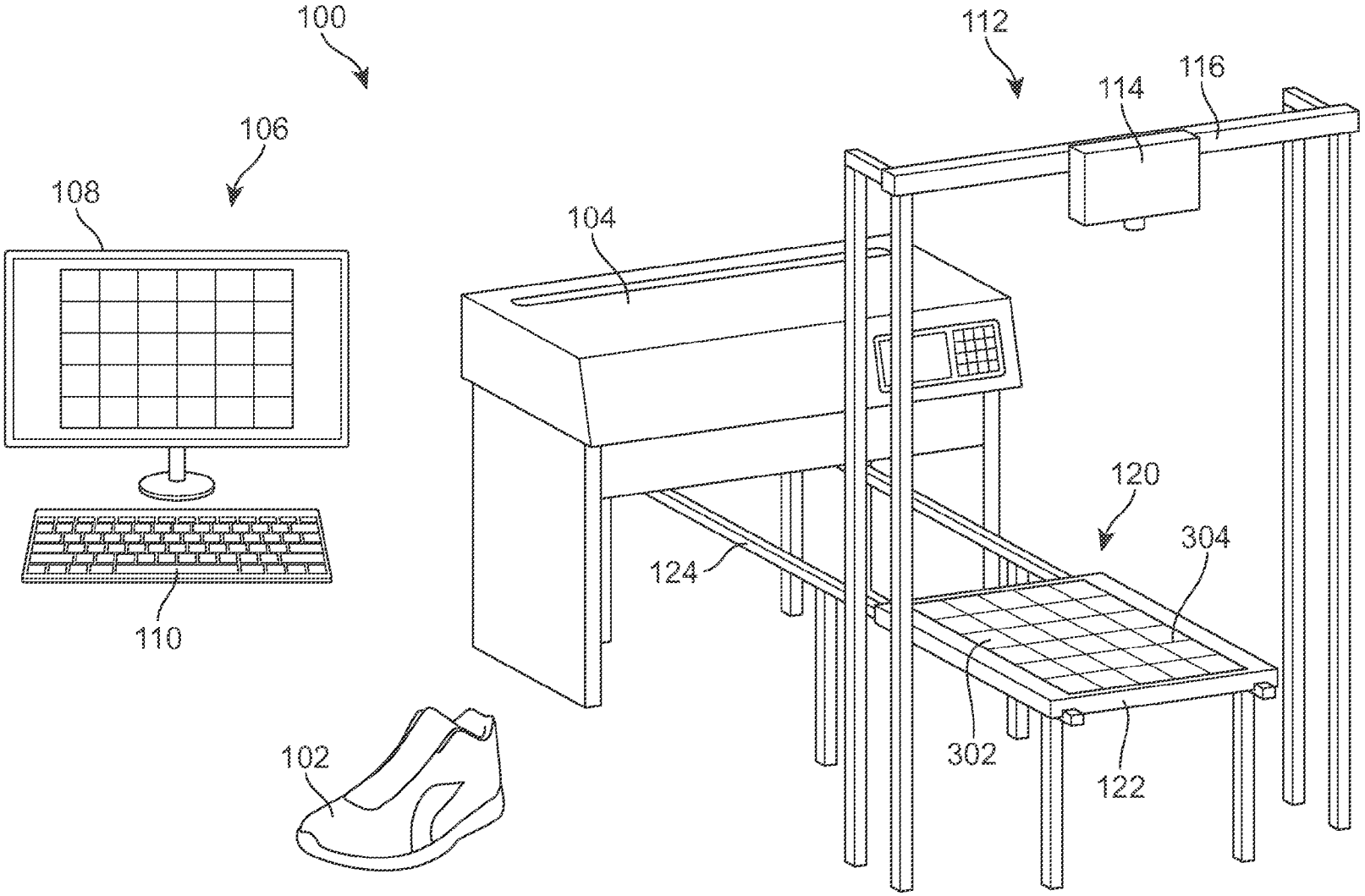
FIG. 4 is a schematic view of an embodiment of a flexible manufacturing system, including a step of moving a platform to a display ready position.

Next, as seen in FIG. 4, platform 122 may be moved from the print ready position to the display ready position. In order to facilitate proper calibration, the print ready position and the display ready position may be distinguished from any possible intermediate positions along tracks 124. In some embodiments, this may be accomplished by markings along tracks 124. In other embodiments, this may be accomplished using features that make the user aware that platform 122 is in either the print read or display read position, such as temporarily locking platform 122 in either position.

Figure 5:
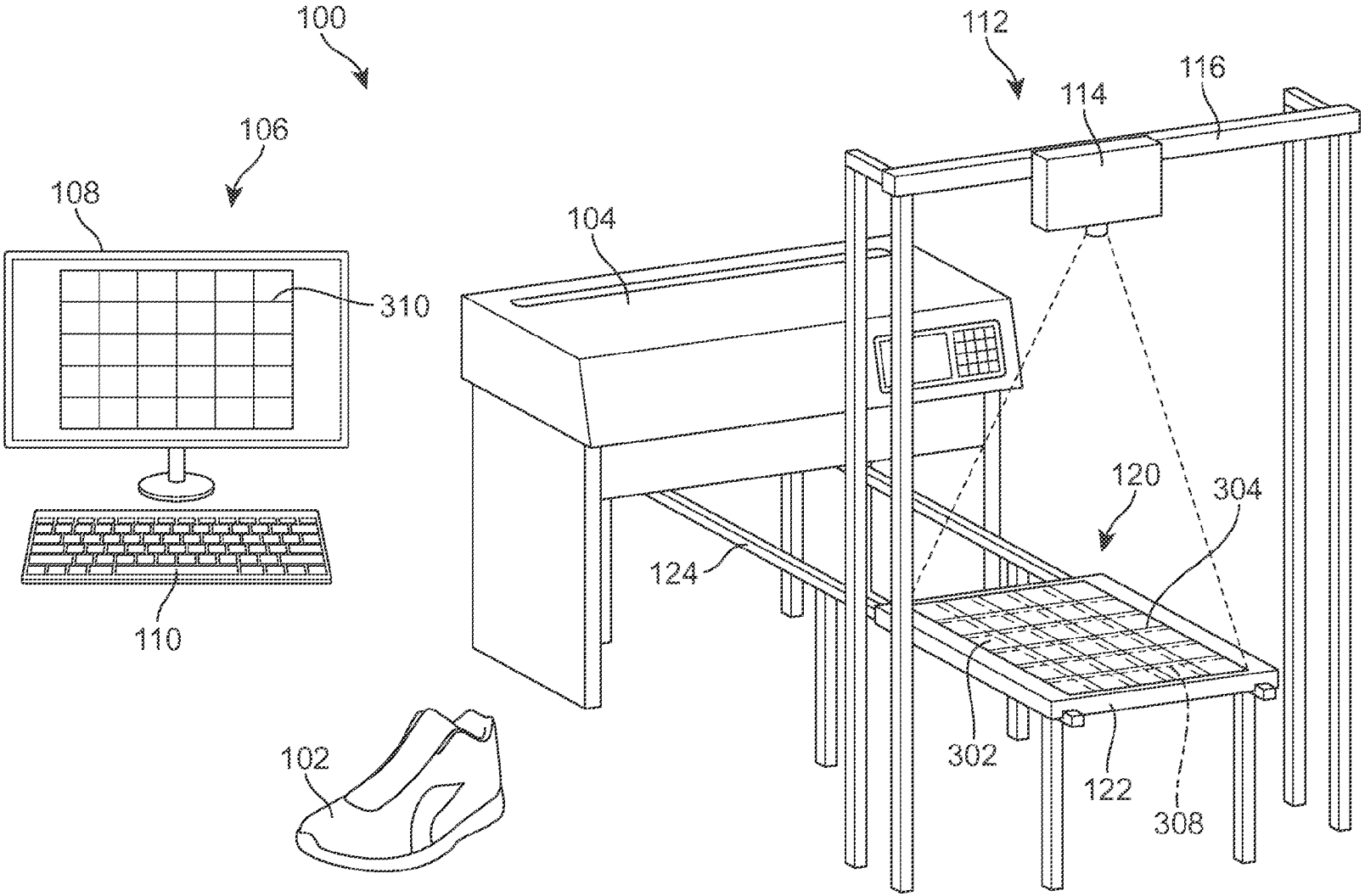
FIG. 5 is a schematic view of an embodiment of a flexible manufacturing system, including a step of projecting a test grid onto the printed grid.

Once platform 122, which carries sheet 302 and printed test grid 304, has been moved to the display ready position, projection system 114 may be operated to project a projected graphic. In this case, projection system 114 may be operated to project test grid 308, as seen in FIG. 5. In some embodiments, both printed test grid 304 and the projected test grid 308 may be created from a single computer graphic, such as test graphic 310, that is generated by computing system 106. In other embodiments, however, printing system 104 and projection system 114 may each generate a test grid from locally stored information, rather than information received from computing system 106.

As seen in FIG. 5, printed test grid 304 and projected test grid 308 may not be initially aligned. In order to calibrate the operation of projection system 114 with printing system 104, projection system 114 may be modified until projected test grid 308 is substantially coincident with printed test grid 304. In some cases, this can be accomplished by adjusting the position of projection system 114 along support frame 116, as shown clearly in FIG. 6.

Figure 6:
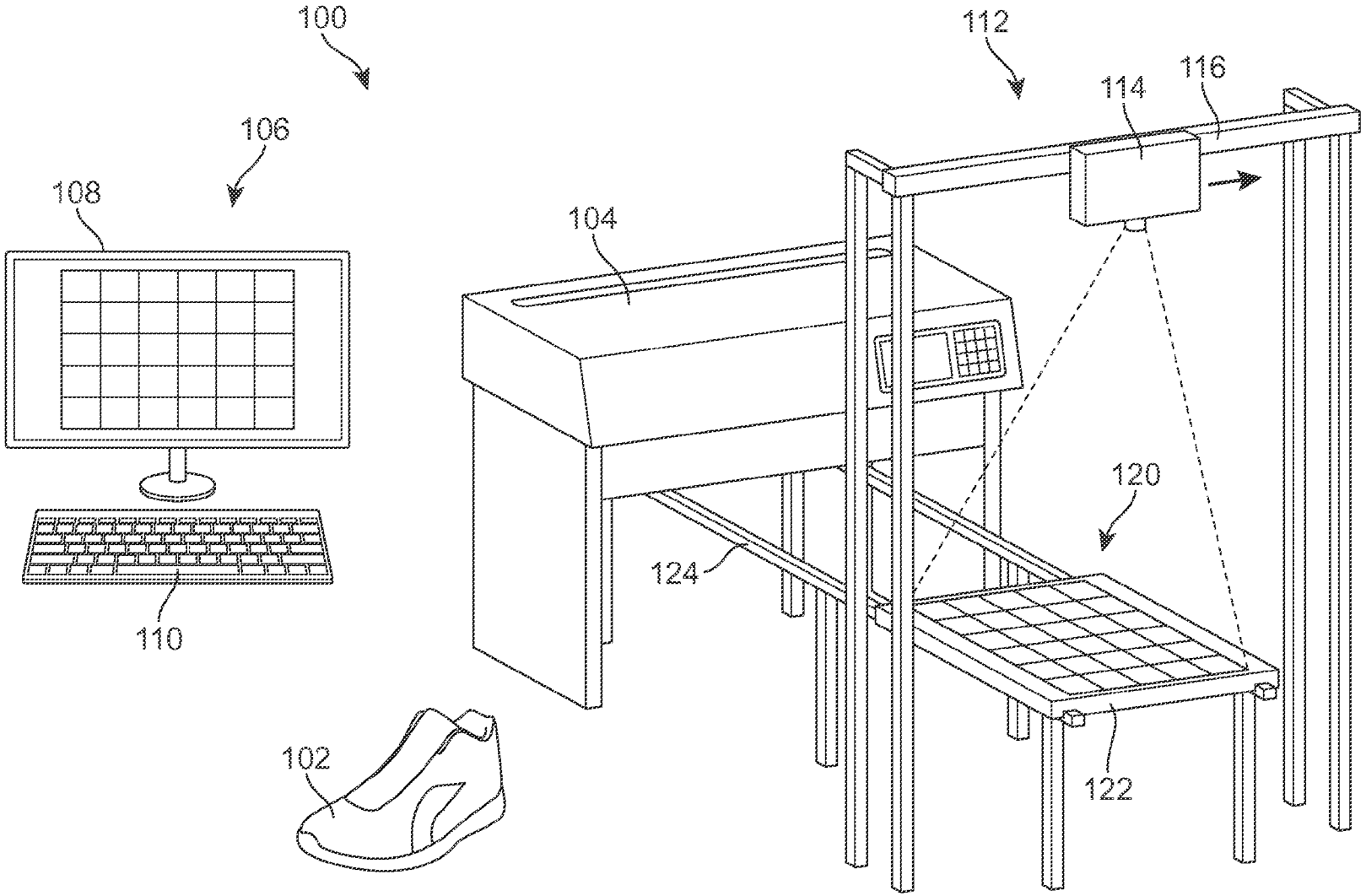
FIG. 6 is a schematic view of an embodiment of a flexible manufacturing system, including a step of adjusting the position of the projection system to align the projected test grid with the printed test grid.

FIG. 6 shows an example where the projection system is adjusted until the projected graphic is aligned with the printed graphic. In this case, the horizontal position of projection system 114 may be adjusted to align displayed test grid 308 and printed test grid 310. However, other cases may include any other kind of movement, including repositioning projection system 114 in any of the usual x, y and z spatial directions. Moreover, some cases may include steps of adjusting the focus of projection system 114 to better align displayed test grid 308 with printed test grid 310. With the calibration process completed, projection system 114 may be properly registered to platform 122.

Figure 7:
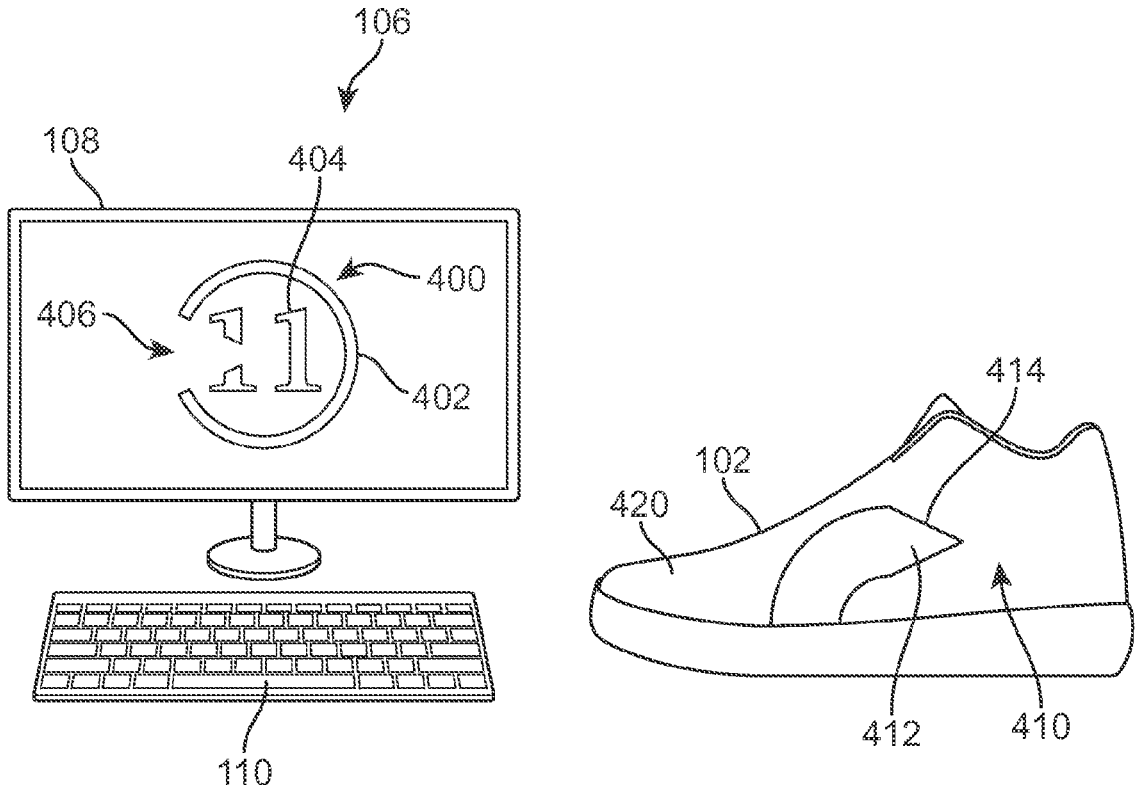
FIG. 7 is a schematic view of an embodiment of a computer graphic that has been designed to be printed onto an article of footwear.

FIG. 7 illustrates a schematic view of an embodiment of a computer graphic 400 that may be applied to article 102. Computer graphic 400 could be stored using computing system 106. In some embodiments, computer graphic 400 may be retrieved from another source. In other embodiments, computer graphic 400 could be designed using software associated with computing system 106. In one embodiment, computer graphic 400 may be a custom designed image that may be applied to article 102 for the purposes of customizing article 102 to suit a particular customer or user.

In one embodiment, computer graphic 400 comprises several design elements including a border 402 and numbers 404. Furthermore, computer graphic 400 may be designed for application to predetermined portion 410 of upper 420. By applying computer graphic 400 to article 102 through printing, article 102 will be configured with a custom graphic.

A computer graphic can be designed with provisions to prevent overlap between a printed graphic and one or more features of an article. For example, some embodiments may utilize graphic templates that help mask one or more portions of a graphic. Such graphic templates could be created using information about the article, including, for example, design information. The masked portions may generally correspond to locations on an article where it may be undesirable to print, such as onto a piece of trim, or onto an existing graphic or image.

In some embodiments, computer graphic 400 can include masked portion 406. In some cases, masked portion 406 comprises a concave, or non-convex, portion of computer graphic 400. Masked portion 406 may be used to prevent printing onto trim element 412 of upper 420. As seen in FIG. 7, the geometry of masked portion 406 may approximately correspond with the geometry of rearward end portion 414 of trim element 412. For example, masked portion 406 may have an approximately triangular shape that coincides with the approximately triangular shape of rearward end portion 414.

Figure 8:
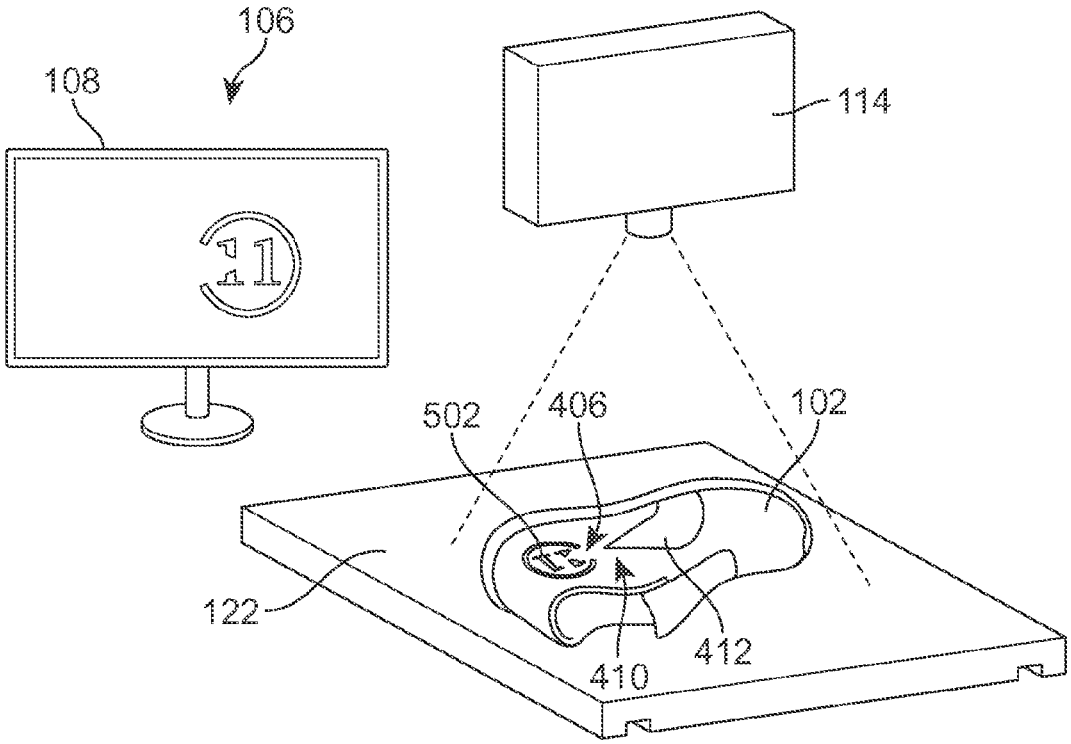
FIG. 8 is a schematic view of an embodiment of a step of projecting a projected graphic onto an article of footwear.
Figure 9:
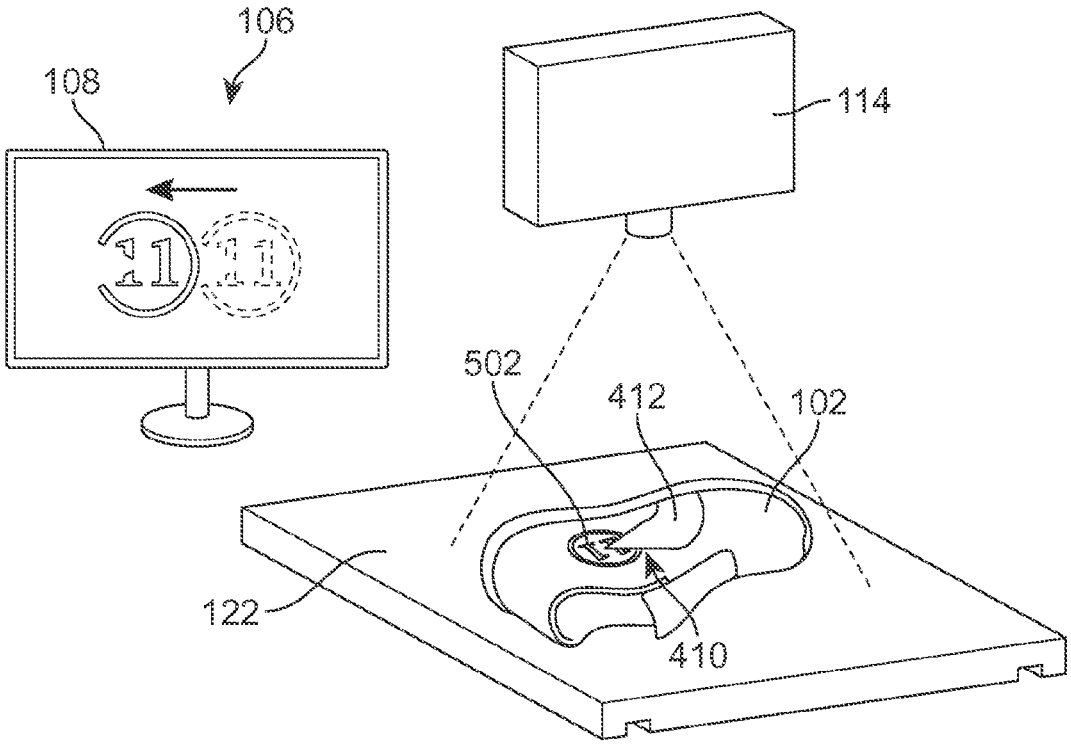
FIG. 9 is a schematic view of an embodiment of a step of aligning a projected graphic onto a predetermined portion of an article of footwear.

FIGS. 8 and 9 illustrate schematic views of a process of aligning a projected graphic 502 onto article 102. In some embodiments, the projected graphic 502 may be generated using information received about computer graphic 400. In some cases, for example, information about computer graphic 400 may be sent from computing system 106 to projection system 114.

Referring first to FIG. 8, initially projected graphic 502 may be disposed in a location adjacent to the predetermined region 410 where the user would like the graphic to be printed. In order to align projected graphic 502 in the proper location the position and/or orientation of projected graphic 502 may be adjusted. In some embodiments, the position of projected graphic 502 may vary as a user adjusts the position of computer graphic 400 on display 108. As seen by comparing the configurations of FIG. 8 and FIG. 9, the position of projected graphic 502 can be adjusted until it is properly aligned within predetermined portion 410. Moreover, in some cases, projected graphic 502 is aligned so that masked portion 406 substantially coincides with rearward end portion 414 of trim element 412. It should be understood that in some embodiments, the position of projected graphic 502 on article 102 could also be adjusted by moving article 102 on platform 122. In other words, the alignment of projected graphic 502 on article 102 may be accomplished by adjusting the relative positions of projected graphic 502 and article 102 in any manner.

Figure 10:
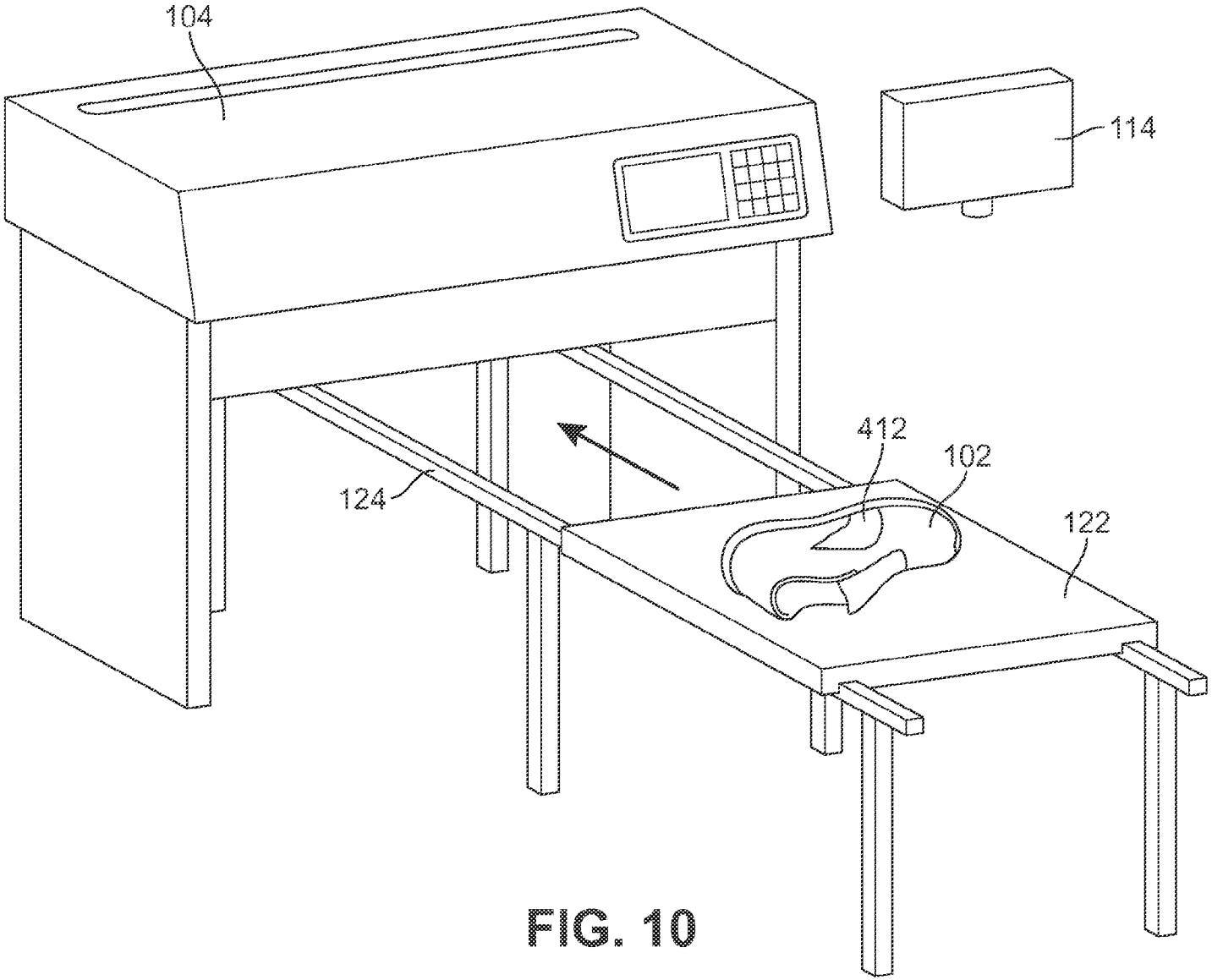
FIG. 10 is a schematic view of an embodiment of a step of moving a platform from a display ready position to a print ready position.
Figure 11:
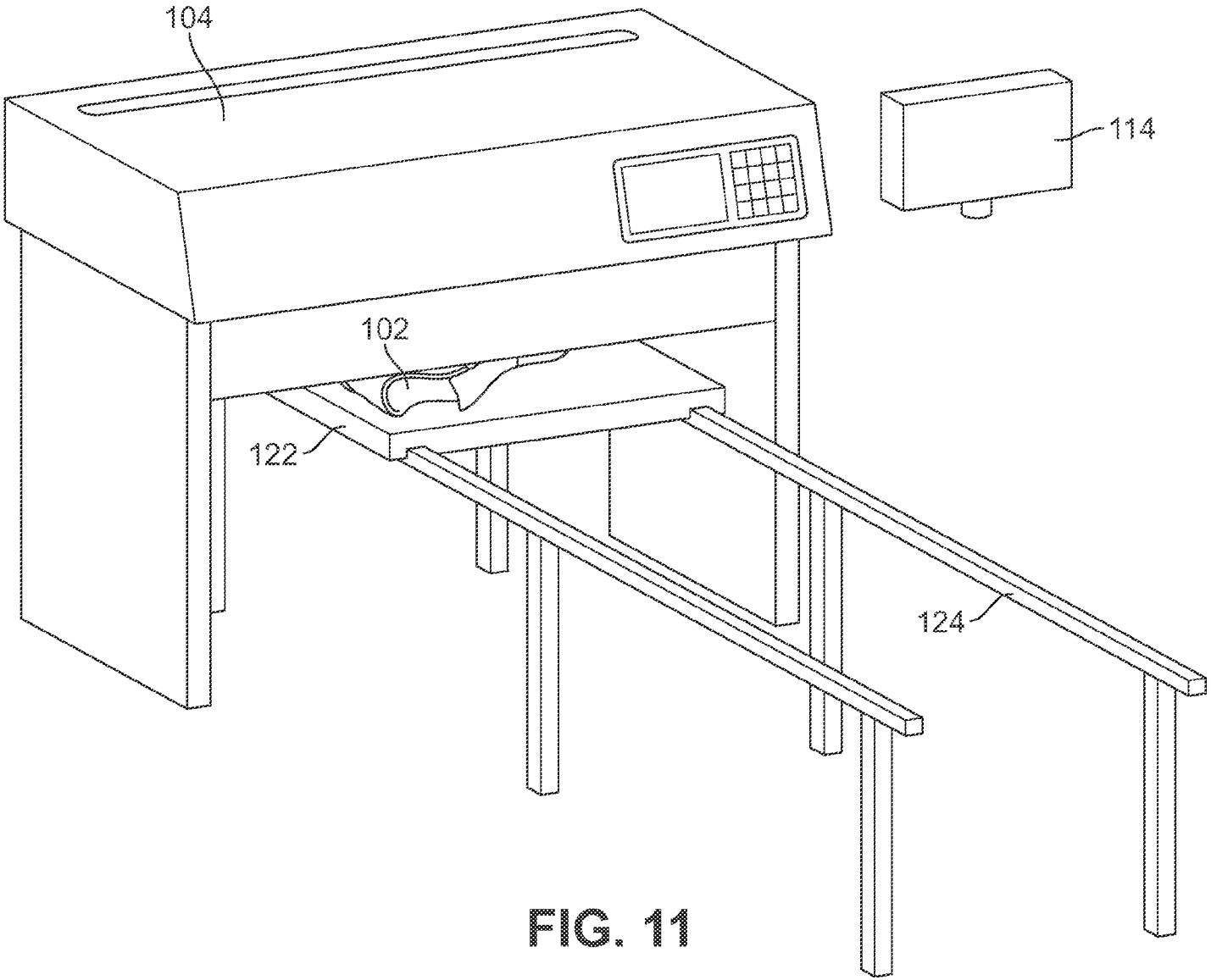
FIG. 11 is a schematic view of an embodiment of a step of printing a graphic onto an article.
Figure 12:
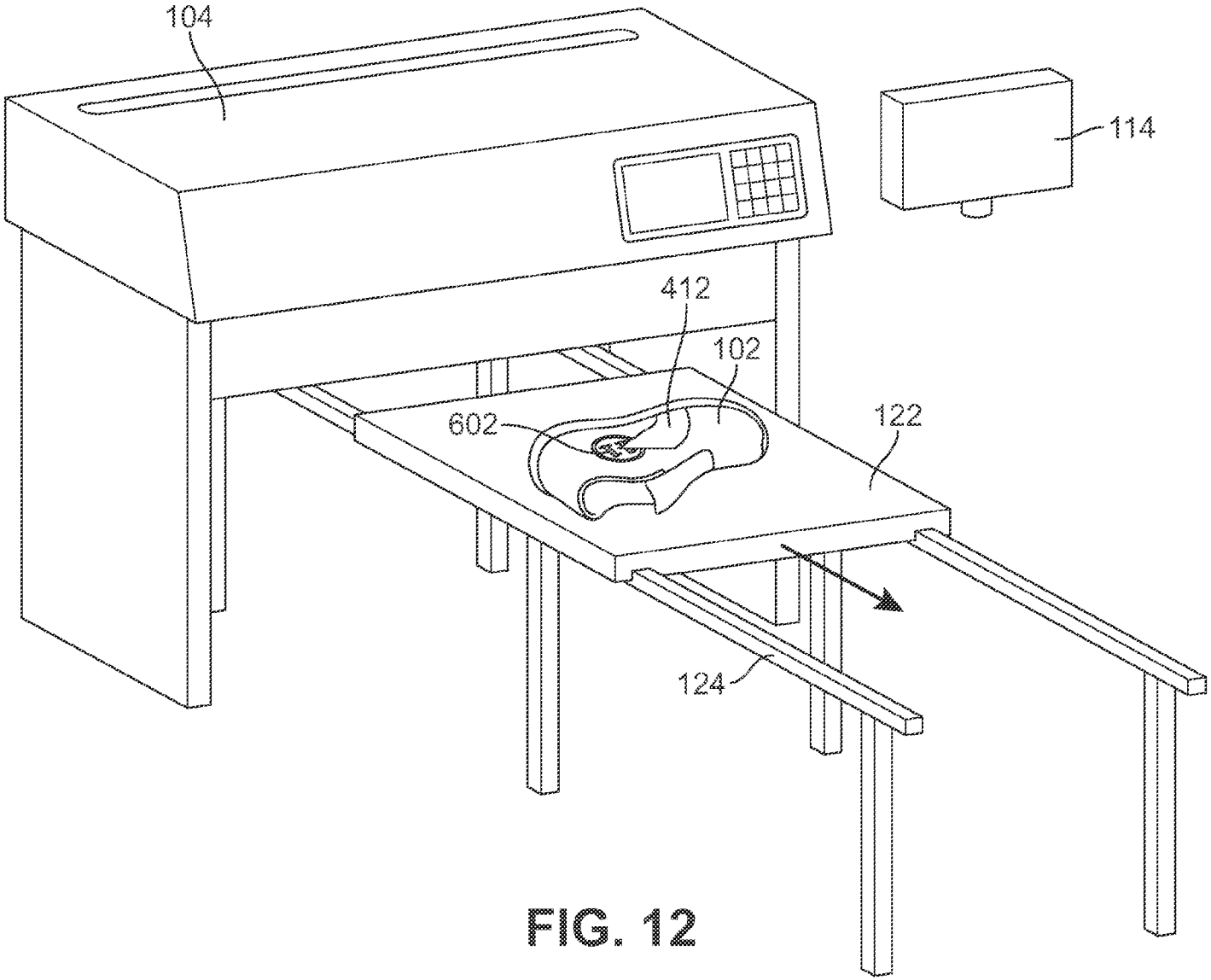
FIG. 12 is a schematic view of an embodiment in which an article includes a recently printed graphic.

FIGS. 10 through 12 illustrate a schematic view of a process of printing a graphic on an article following alignment with projection system 114. Referring to FIG. 10, platform 122 may be moved from the display ready position to the print ready position. In some cases, a user may manually adjust the position of platform 122 along tracks 124. In other cases, platform 122 may be automatically repositioned along tracks 124.

Referring to FIG. 11, platform 122 may be in the print ready position, in which article 102 is disposed beneath one or more print heads of printing system 104. At this point, printed graphic 602 (see FIG. 12) may be printed to predetermined portion 410. In some embodiments, printed graphic 602 corresponds to computer graphic 400. In some embodiments, printed graphic 602 may be generated using information about computer graphic 400 that is received from computing system 106. Finally, as seen in FIG. 12, printed graphic 602 has been printed in predetermined portion 410. Moreover, printed graphic 602 is positioned and oriented as to not overlap with trim element 412, as previously described.

A flexible manufacturing system can include provisions to increase usability of a system. In some embodiments, the arrangement of a printing system and a projecting system can be selected to improve usability, for example, by arranging the projecting system in a manner that increases focal length. Increasing focal length of the projection system may facilitate enhanced usability and accuracy of the system.

Figure 13:
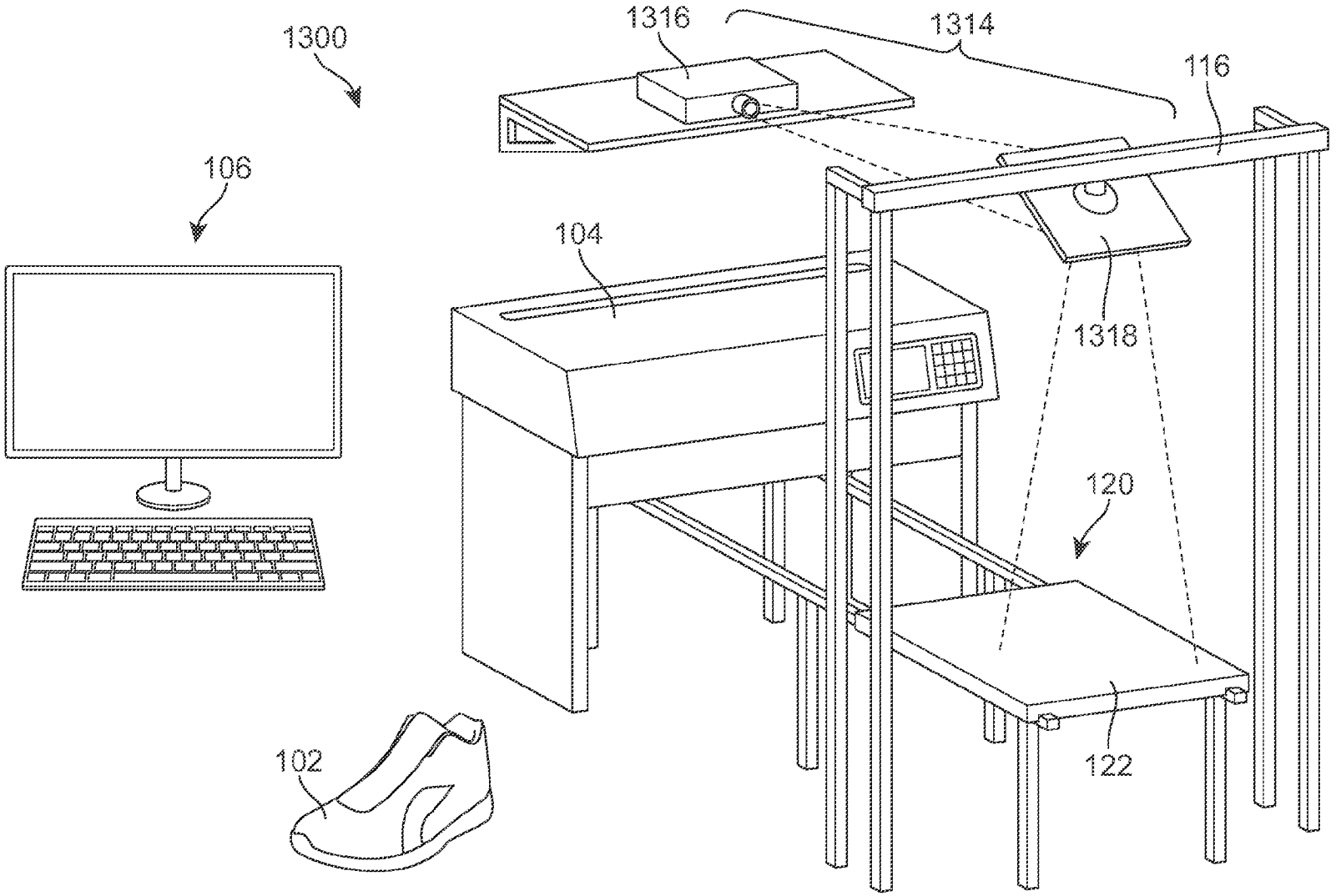
FIG. 13 is a schematic view of another embodiment of a flexible manufacturing system.
Figure 14:
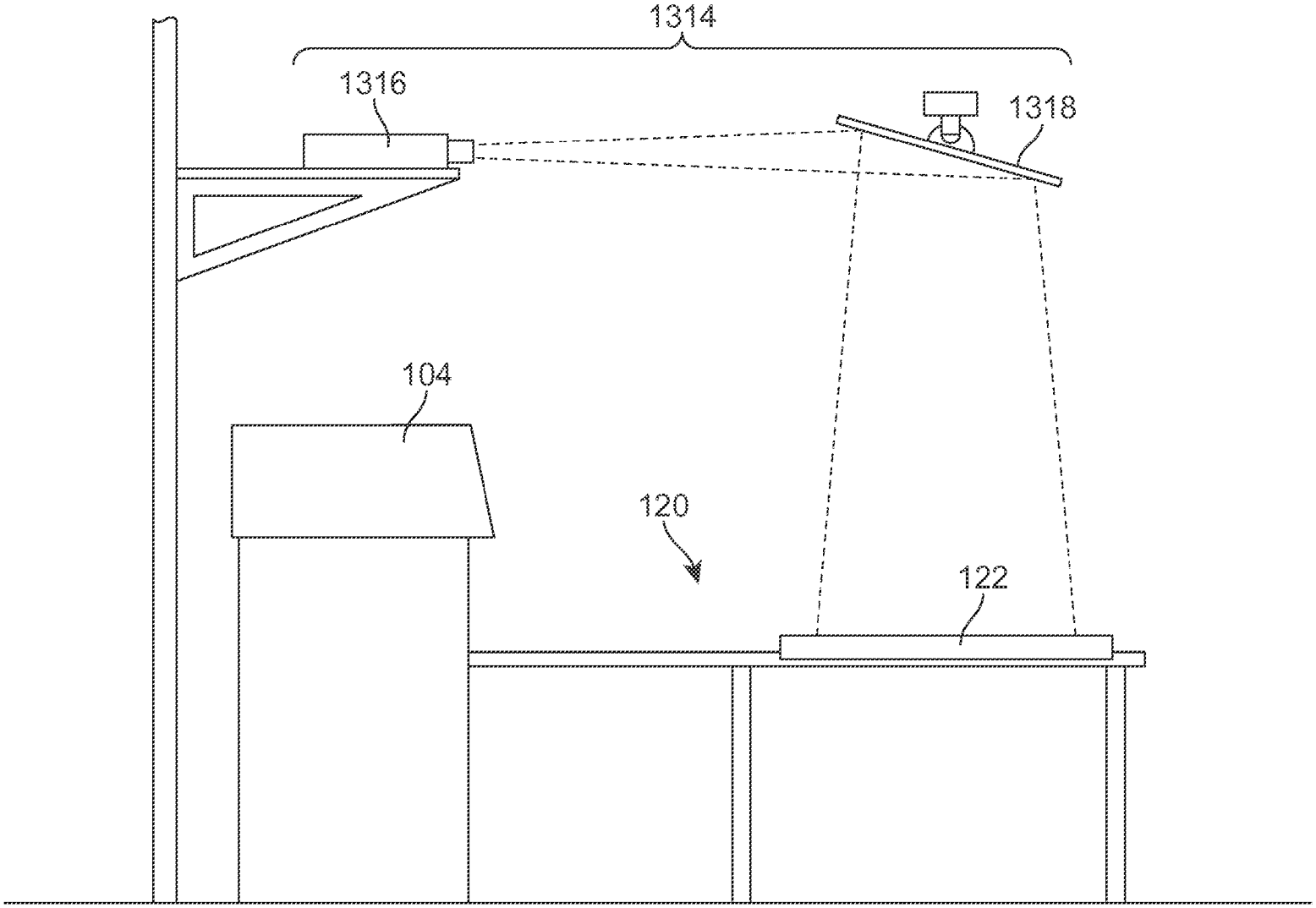
FIG. 14 is a schematic side view of the flexible manufacturing system of FIG. 13.

FIGS. 13 and 14 illustrate schematic isometric and schematic side views, respectively, of another embodiment of a flexible manufacturing system 1300. Referring to FIGS. 13 and 14, flexible manufacturing system 1300 may be similar in some, but not all, respects to flexible manufacturing system 100 described above. In particular, flexible manufacturing system 1300 may include printing system 104, transfer system 120 and computing system 106. Furthermore, as with the previous embodiments, flexible manufacturing system 1300 may be configured for use with article of footwear 102.

In contrast to the previous embodiments, however, flexible manufacturing system 1300 provides a substantially different arrangement for projection system 1314. In one embodiment, projection system 1314 comprises projector 1316 that may be disposed above printing system 104. Additionally, in some embodiments, projection system 1314 also includes mirror 1318, which may be mounted to support frame 116 in some cases. Using this particular arrangement, light projected from projector 1316 is reflected at mirror 1318 down to platform 122.

The increased focal length provided in this particular embodiment may improve operation of flexible manufacturing system 1300. For example, the increased focal length for projection system 1314 allows for the projected image to be better aligned on platform 122 without the need to use vertical lens shift, which can decrease the sharpness of an image. Improving sharpness of a projected image or graphic may improve the accuracy of alignment between projection system 1314 and printing system 104. Furthermore, the focal length of the projection system is increased without increasing the overall dimensions of flexible manufacturing system 1300, whose maximum length may still be approximated by the distance between printing system 104 and platform 122 and whose maximum height may still be approximated by the height of support frame 116.

Although a particular relative position for projector 1316 and mirror 1318 are shown here, it should be understood that these relative positions could vary in any desired manner in other embodiments. For example, projection system 1314 could be disposed behind printing system 104. Additionally, the distance between projector 1316 and mirror 1318, as well as the distance between mirror 1318 and platform 122 could vary according to the desired focal length, for example. Still further, it will be understood that the relative position and orientation of mirror 1318 may be adjustable in different embodiments in order to achieve desired optical features for a projected graphic.

A flexible manufacturing system can include provisions for limiting the movement of an article during the customization process. In some embodiments, the platform onto which an article is placed may not move. Instead, in some embodiments, a printing system may be configured to move between an inactive position and an active position as the flexible manufacturing system proceeds from an alignment stage to a printing stage.

Figure 15:
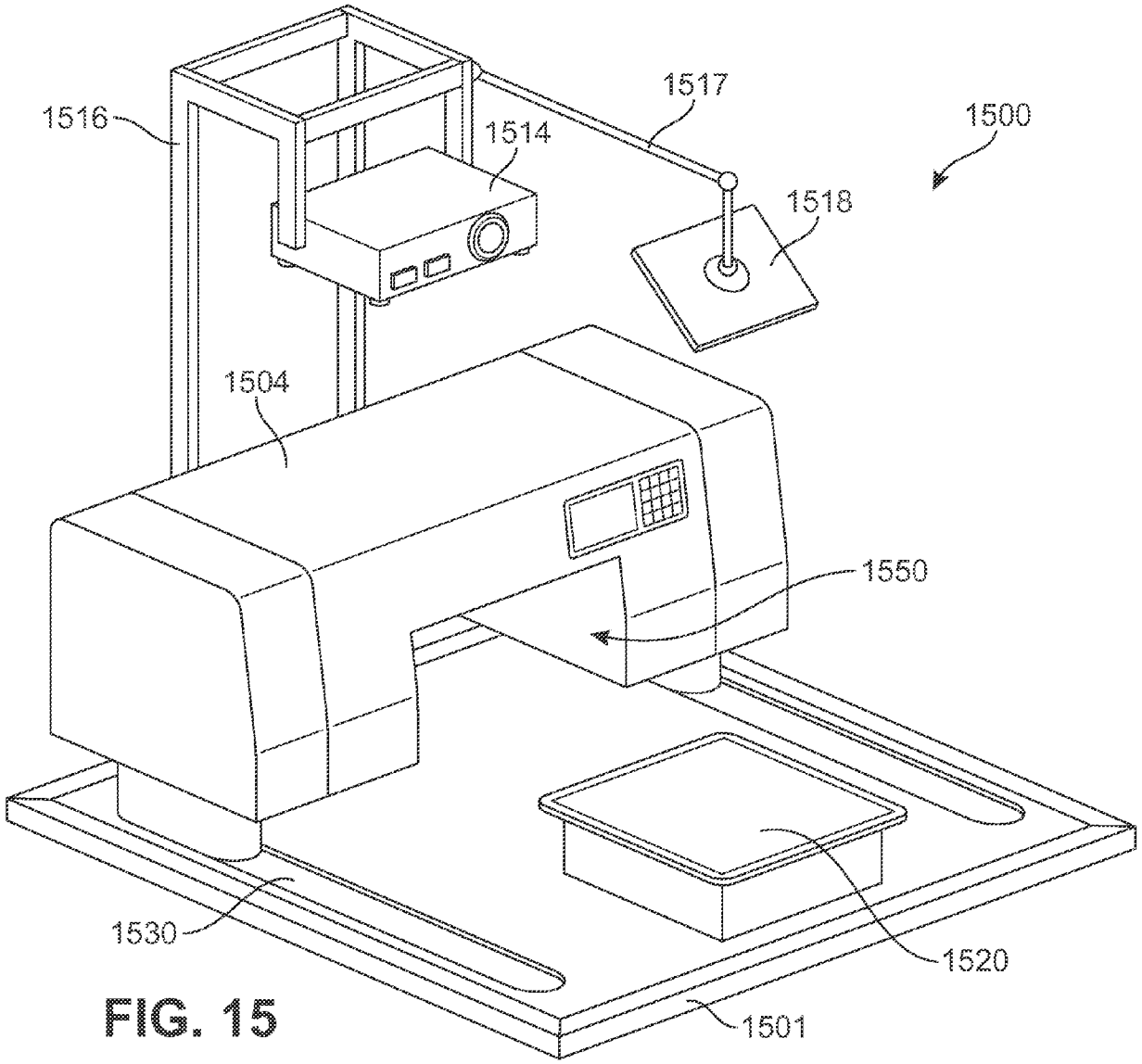
FIG. 15 is a schematic isometric view of another embodiment of a flexible manufacturing system with a printer in a first position.
Figure 16:
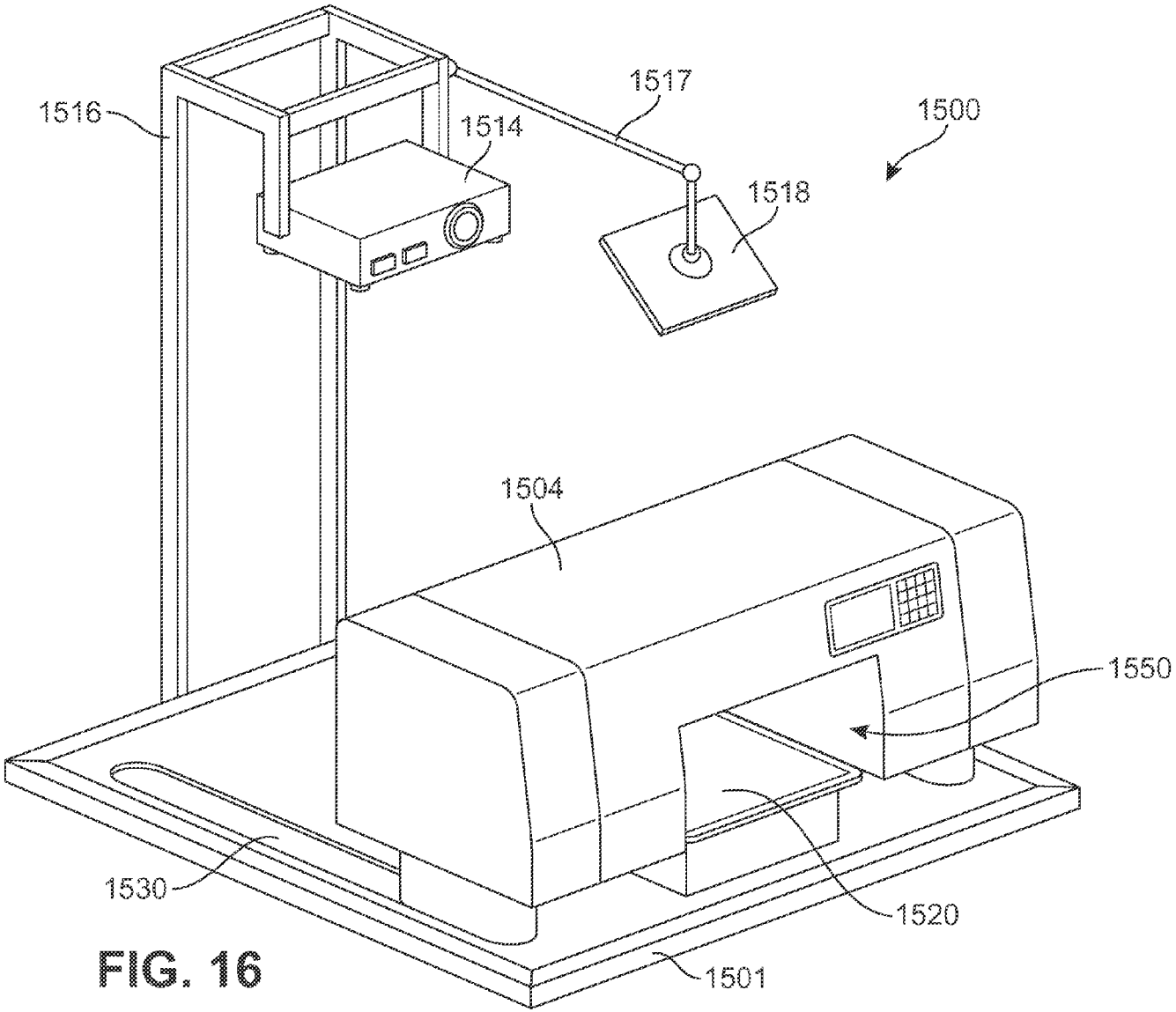
FIG. 16 is a schematic isometric view the flexible manufacturing system of FIG. 15 in which the printer is in a second position.

FIGS. 15 and 16 illustrate schematic views of another embodiment of a flexible manufacturing system 1500, in which a printing system is capable of moving to various positions. Referring to FIGS. 15 and 16, flexible manufacturing system 1500 includes base portion 1501 printing system 1504, alignment system 1512 and stationary platform 1520. Base portion 1501 may comprise a substantially flat surface for mounting one or more components of flexible manufacturing system 1500. Additionally, in some embodiments, stationary platform 1520 comprises a surface for receiving one or more articles. In some cases, stationary platform 1520 is fixed approximately in place on base portion 1501, in contrast to the movable platform 122 of the previous embodiments.

Flexible manufacturing system 1500 can also include a support frame 1516, which may be used to mount projection system 1514. In some cases, support frame 1516 could be attached directly to base portion 1501. In other cases, however, support frame 1516 may be independent of base portion 1501 and the position of support frame 1516 may be adjusted in relation to base portion 1501. Support frame 1516 may be further associated with mounting arm 1517 that extends outwardly from support frame 1516 and further supports mirror 1518. As seen in FIG. 15, this arrangement allows images projected from projection system 1514 to be projected onto stationary platform 1520 (and onto any objects and/or articles disposed on stationary platform 1520).

In some embodiments, printing system 1504 may be mounted to tracks 1530 of base portion 1501. In some cases, printing system 1504 is mounted in a movable manner to base portion 1501, so that printing system 1504 is capable of sliding along tracks 1530. This allows printing system 1504 to move between a first position (seen in FIG. 15) and a second position (seen in FIG. 16). In other words, in this embodiment, alignment of a graphic on an article may be done while printing system 1504 is in the first, or inactive, position. With printing system 1504 in this inactive position, printing system 1504 is disposed away from stationary platform 1520 and does not interfere with the projection of images by projection system 1514. Once the graphic alignment has been completed, printing system 1504 could be moved to the second, or active, position. In this active position, printing system 1504 may be disposed directly over stationary platform 1520 and may be configured to print a graphic onto an article that may be disposed on stationary platform 1520. In some cases, to help provide clearance for any article disposed on stationary platform 1520, printing system 1504 can be configured with printing bay portion 1550.

Although the current embodiments include a projection system as a means for aligning a graphic with an article, still other embodiments could make use of other devices or systems for aligning a graphic on an article. For example, some embodiments could utilize a substantially transparent display (such as an LCD screen) for aligning a graphic on an article. In such an embodiment, alignment could be achieved by suspending such a display over an article and displaying a graphic so that it is aligned over the desired region of the article. Moreover, in other embodiments still other technologies could be used for aligning graphics with a portion of an article prior to printing.

For purposes of description, the term "projection area" is used throughout this detailed description and in the claims to refer to an area where a projected graphic may be displayed onto an article or some other object. In particular, the projection area may be associated with any region of space along the optical path of the projection system. In some cases, the projection area may approximately designate the location where a projected graphic is displayed on an object (such as an article and/or platform).

A flexible manufacturing system can include provisions for displaying a real-time view of a projection area on a remote device. For example, in one embodiment an optical device (such as a camera) may be used to record a live feed of the projection area. The live feed may then be transmitted to a remote device, where the user may view the projection area in order to determine the alignment between the projected graphic and an article disposed in the projection area.

Figure 17:
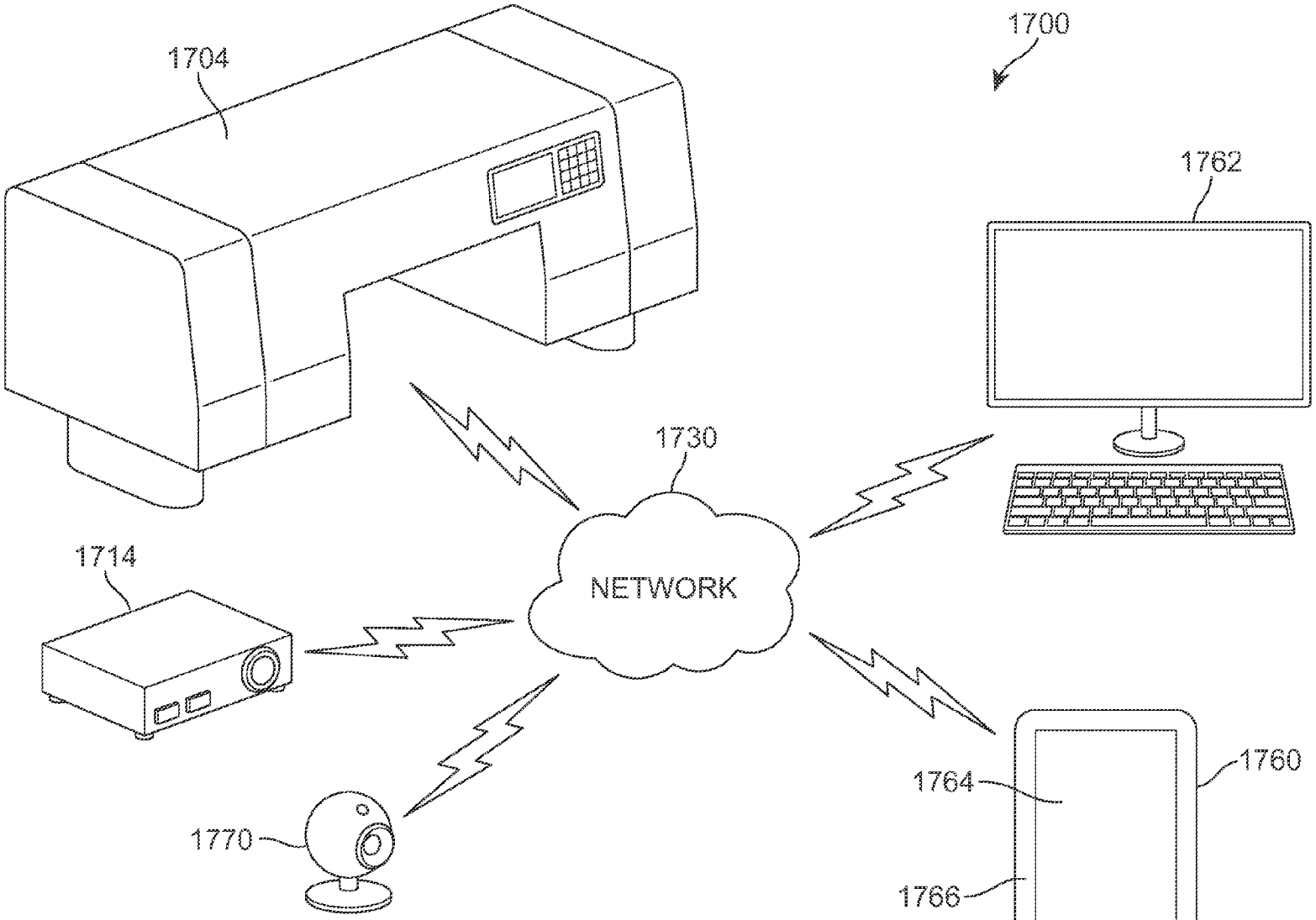
FIG. 17 is a schematic view of various components of a flexible manufacturing system, according to an embodiment.

FIG. 17 illustrates a schematic view of flexible manufacturing system 1700, which includes some components that are similar to previous embodiments as well as some substantially new components. Referring to FIG. 17, flexible manufacturing system 1700 may include printing system 1704 and projection system 1714, which is calibrated with printing system 1704 in the manner previously described.

Flexible manufacturing system 1700 can also include one or more remote devices, such as first remote device 1760 and second remote device 1762. As shown in FIG. 17, second remote device 1762 could be substantially similar to computing system 106 (see FIG. 1). In particular, in some cases, second remote device 1762 could comprise a desktop computing device including a display, keyboard, processor and other provisions.

First remote device 1760, also referred to simply as remote device 1760, may comprise a tablet-like computing device. Remote device 1760 may be configured with similar provisions to other computing devices. In some embodiments, remote device 1760 may include processing components, memory components, input and output components as well as display components. These various components may be housed within outer casing 1766. In contrast to some other kinds of computing devices, a tablet-like device may comprise a single touch screen panel that functions as a display as well as an input device. For example, first remote device 1760 may comprise interaction and display panel 1764, or simply panel 1764, which extends over a majority of casing 1766.

Other examples of remote devices that may be used include, but are not limited to: tablet computing devices, smart phone devices, personal digital assistant devices (PDAs), laptop computers, desktop computers, netbook computers as well as any other computing devices. As one example, remote device 1760 could be an iPad manufactured by Apple Computer, Inc.

In some embodiments, flexible manufacturing system 1700 can include provisions for capturing optical information. In one embodiment, flexible manufacturing system 1700 can include optical device 1770. Optical device 1770 may be any kind of device capable of capturing image information including both still images as well as video images. Examples of different optical devices that can be used include, but are not limited to: still-shot cameras, video cameras, digital cameras, non-digital cameras, web cameras (web cams), as well as other kinds of optical devices known in the art. The type of optical device may be selected according to factors such as desired data transfer speeds, system memory allocation, desired temporal resolution for viewing a projection area, desired spatial resolution for viewing a projection area as well as possible other factors. In one embodiment, optical device 1770 may be a digital video camera. In one embodiment, optical device 1770 may be a web-camera.

Flexible manufacturing system 1700 may include provisions to facilitate communication between two or more systems, devices and/or components. As one possible example, flexible manufacturing system 1700 is shown here to include a network 1730. In some cases, network 1730 may be a wireless network that facilitates wireless communication between two or more systems, devices and/or components of flexible manufacturing system 1700. Examples of wireless networks include, but are not limited to: wireless personal area networks (including, for example, Bluetooth), wireless local area networks (including networks utilizing the IEEE 802.11 WLAN standards), wireless mesh networks, mobile device networks as well as other kinds of wireless networks. In other cases, network 1730 could be a wired network including networks whose signals are facilitated by twister pair wires, coaxial cables, and optical fibers. In still other cases, a combination of wired and wireless networks and/or connections could be used.

It should be understood that in some embodiments, rather than utilizing a network-type communication between various components, devices and/or systems, some components can be connected directly to each other, and may not communicate with all other components. For example, in some cases, printing system 1704 and projection system 1714 could be connected directly to second remote device 1762 and could operate as peripheral devices to second remote device 1762. In other words, it will be understood that network 1730 is only intended as one possible example of a configuration for connecting various components, devices and/or systems. The type of communication method can be selected according to various factors including, for example, desired data transfer speeds, requirements for the locations of various components, ease of connectivity, compatibility between various devices, components and systems, as well as possibly other factors.

Figure 18:
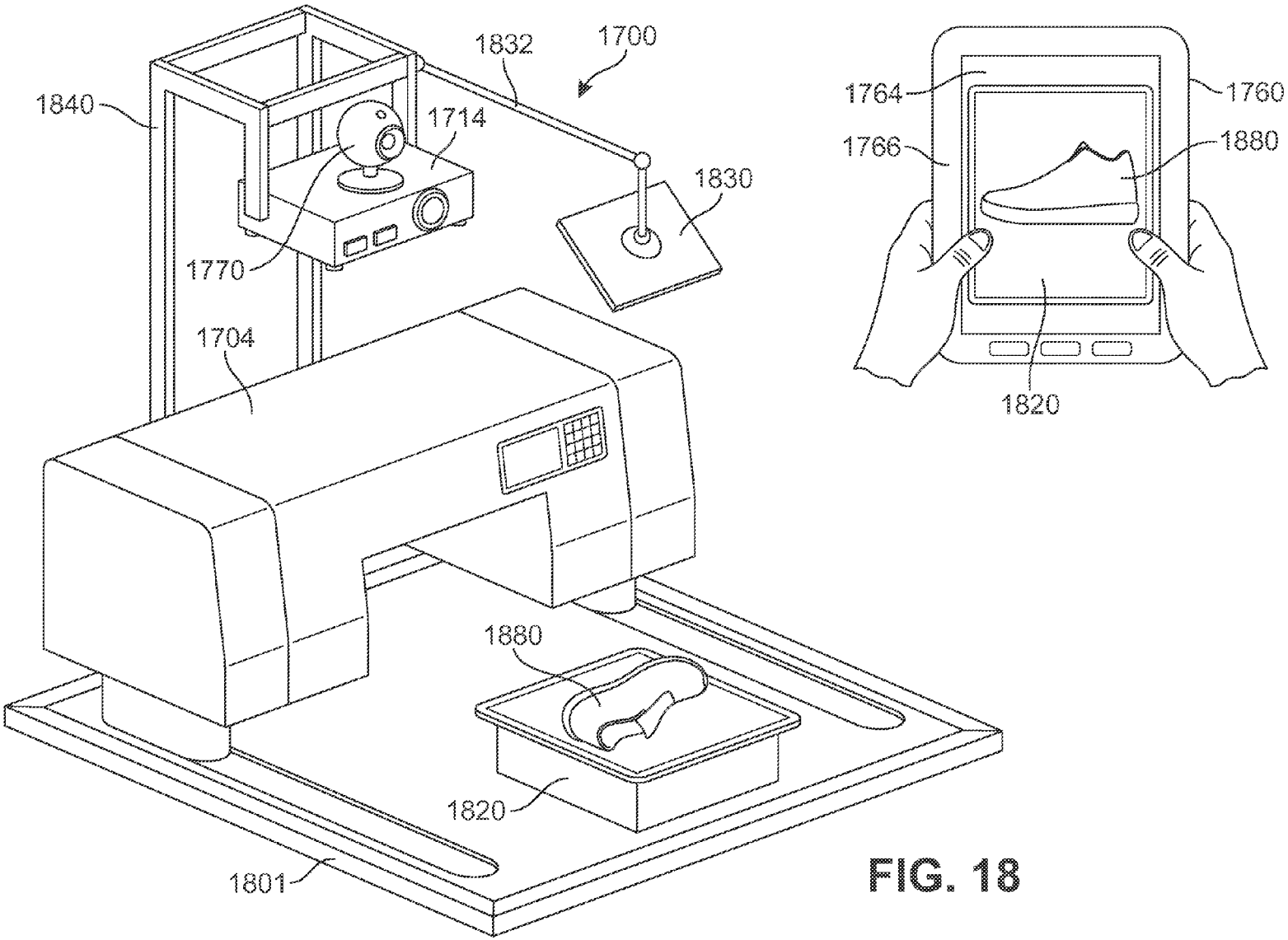
FIG. 18 is a schematic view of an embodiment of a flexible manufacturing system in which a projection area is viewable on a remote device.

FIG. 18 illustrates a schematic view of various components of flexible manufacturing system 1700 arranged in an exemplary configuration. Referring to FIG. 18, printing system 1704 may be mounted to base portion 1801 in a manner so that printing system 1704 may translate, or move across, base portion 1801. This arrangement may be substantially similar to the arrangement of printing system 1504 and base portion 1501 shown in FIGS. 15 and 16, which has been previously described above. In addition, in some embodiments, a stationary platform 1820, or simply platform 1820, may be mounted to base portion 1801 so that stationary platform 1820 stays approximately fixed in place with respect to base portion 1801.

Projection system 1714 may be positioned approximately over printing system 1704. In some embodiments, projection system 1714 is supported using support frame 1840. Furthermore, in a similar manner to previous embodiments, flexible manufacturing system 1700 further includes mirror 1830 that may be attached to mounting arm 1832, which extends outwardly from support frame 1840. Projection system 1714, mirror 1830 and stationary platform 1820 may be arranged so that images or graphics projected from a lens of projection system 1714 is reflected from mirror 1830 and onto stationary platform 1820 (and any articles or objects disposed on stationary platform 1820).

Figure 19:
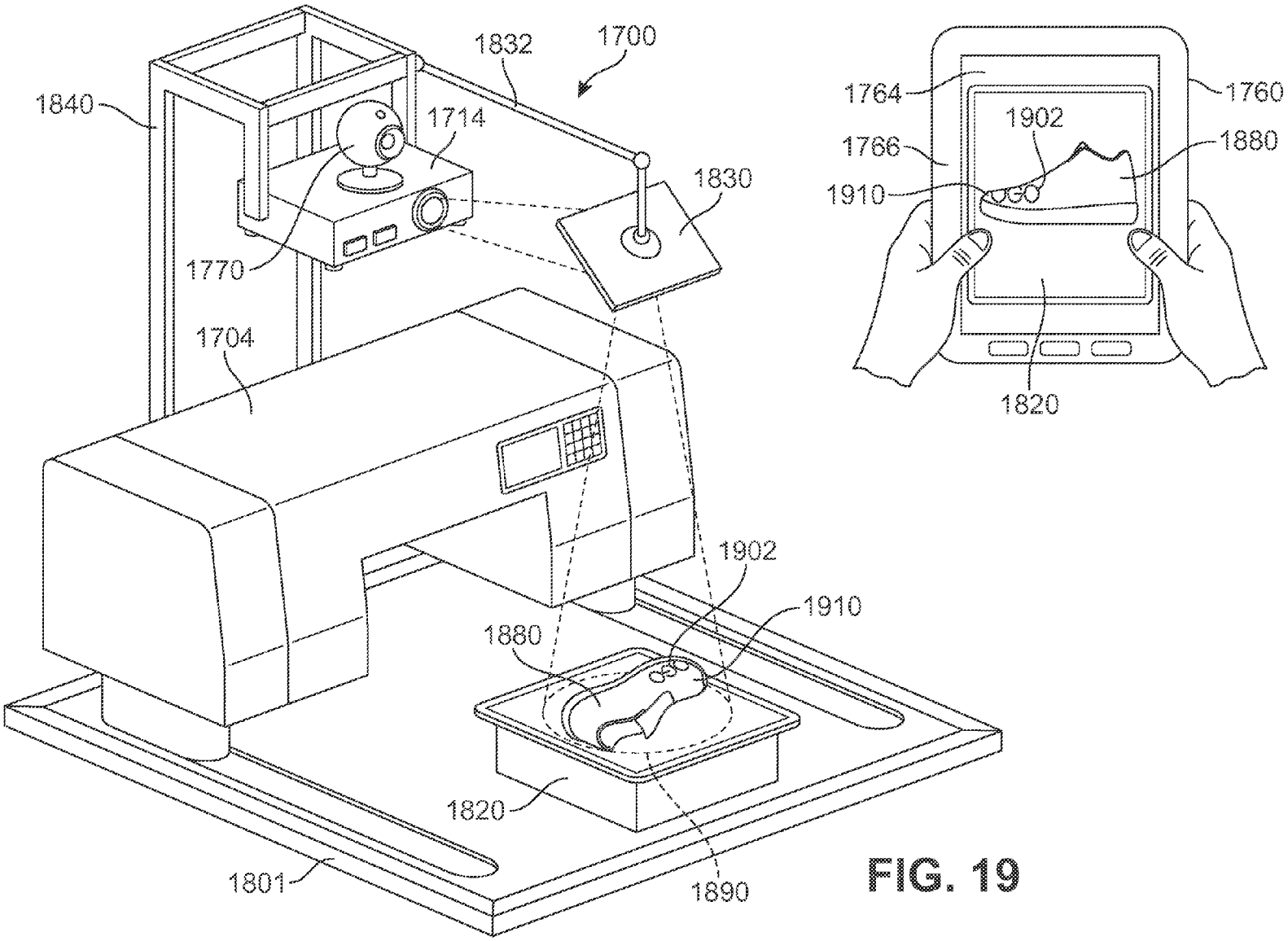
FIG. 19 is a schematic view of the flexible manufacturing system of FIG. 18, in which a graphic has been projected onto a portion of an article.

As previously mentioned, stationary platform 1820 and an article 1880 may be associated with projection area 1890 (see FIG. 19). In some cases, projection area 1890 may generally encompass article 1880 as well as some portions or even all of stationary platform 1820. Any graphics or other images projected by projection system 1714 may be visible upon contact with an object in projection area 1890.

In some embodiments, optical device 1770 may be disposed adjacent to projection system 1714. This may allow optical device 1770 to capture image information corresponding to projection area 1890, which may be reflected by mirror 1830. The term "image information", as used throughout this detailed description and in the claims refers to any information that may be captured by an optical or imaging device, and includes, for example, photographic information and video information. For purposes of clarity, optical device 1770 is illustrated in the figures as disposed on top of projection system 1714. However, in other embodiments the location and/or orientation of optical device 1770 can be varied. For example, optical device 1770 could be disposed above, below, to either side of, forwards of, and/or behind projection system 1714. In still other embodiments, as shown for example in FIGS. 21 and 22 (and discussed in further detail below), an optical device may not be disposed adjacent to a projection system.

As seen in FIG. 18, a view of some components of flexible manufacturing system 1700 may be seen by a user who is viewing remote device 1760. In particular, image information captured by optical device 1770 may be displayed on remote device 1760. In the embodiment of FIG. 18, both platform 1820 and article 1880 are visible on panel 1764 of remote device 1760. Moreover, due to the viewing angle of optical device 1770, this view is an approximately straight down or overhead view. This overhead view may help the user to clearly view portions of flexible manufacturing system 1700 (and in particular projection area 1890) for purposes of aligning a graphic on article 1880. It will be understood that the viewing angle of these components as seen by the user can be varied by varying the location and/or orientation of optical device 1770 as well as by varying the position of mirror 1830.

Figure 20:
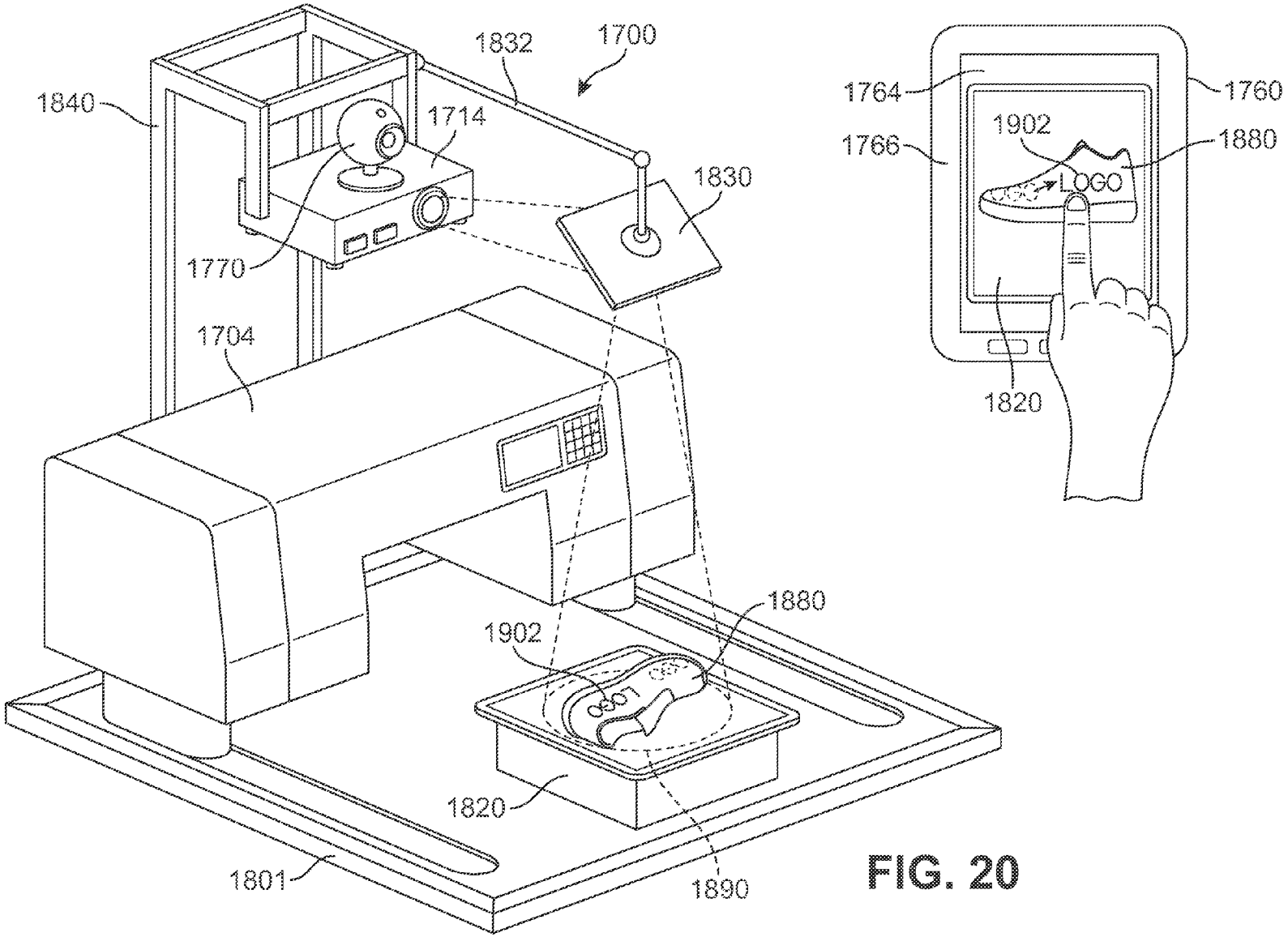
FIG. 20 is a schematic view of the flexible manufacturing system of FIG. 19, in which a graphic has been moved to a different portion of the article using the remote device.

FIGS. 19 and 20 illustrate schematic views of a situation in which the alignment of a graphic on an article can be controlled by a user by interacting with remote device 1760. Referring first to FIG. 19, projection system 1714 projects graphic 1902 onto article 1880. Graphic 1902 is initially aligned with a forefoot portion 1910 of article 1880, which may be undesired in this case. A user may visually inspect the alignment of graphic 1902 on article 1880 by way of the image information that is displayed on remote device 1760.

In order to adjust the alignment of graphic 1902 on article 1880, a user may interact with panel 1764 as shown in FIG. 20. In particular, the touch-screen capability of remote device 1760 may allow the user to simply touch graphic 1902 and reposition graphic 1902 by, for example, sliding his or her finger across panel 1764. In other words, the user may drag graphic 1902 to a desired predetermined portion on article 1880.

The type of interaction depicted in FIGS. 19 and 20 can be achieved in various different ways and the embodiments are not intended to be limited to a particular method. Generally, image information is displayed to a user on remote device 1760 and a user interacts with remote device 1760 to adjust the alignment of graphic 1902 on article 1880. Based on input provided by the user (through touch gestures, for example), remote device 1760 may then transmit alignment information to projection system 1714. The alignment information may generally include updated positional information for the desired location of graphic 1902.

In one embodiment, for example, remote device 1760 may include software that is configured to identify graphic 1902 and its relative position. The software may then associate an interactive location on panel 1764 with graphic 1902. As a user touches the portion of panel where graphic 1902 is displayed, the system may recognize that the user intends to control the position and/or other characteristics of graphic 1902. Therefore, as a user moves his or her finger across panel 1764, for example, remote device 1760 communicates with projection system 1714 so that graphic 1902 is moved through the projection area 1890 in a substantially similar manner.

For purposes of clarity, the embodiments shown here illustrate a simple translation of the position of a graphic for purposes of aligning the graphic in a desired position on an article. However, it will be understood that any kind of transformation of a graphic may be possible in various embodiments. Examples of possible transformations that may be achieved through user interaction with remote device 1760 include, but are not limited to: translations, rotations, inversions, scalings as well as possibly other transformations. Moreover, some embodiments could include provisions for editing a graphic through remote device 1760 (e.g., cropping, coloring, distorting, etc.). This would increase the adaptability of flexible manufacturing system 1700 and allow a user to make changes in real-time.

Once the desired alignment of graphic 1902 with article 1880 has been achieved, flexible manufacturing system 1700 may be used to print a printed graphic onto article 1880 using the methods described above. In particular, with projection system 1714 and printing system 1704 calibrated as described above, a graphic can be printed onto article 1880 so that the printed graphic is associated with the same predetermined portion of article 1880 where the projected graphic 1902 had been placed.

Figure 21:
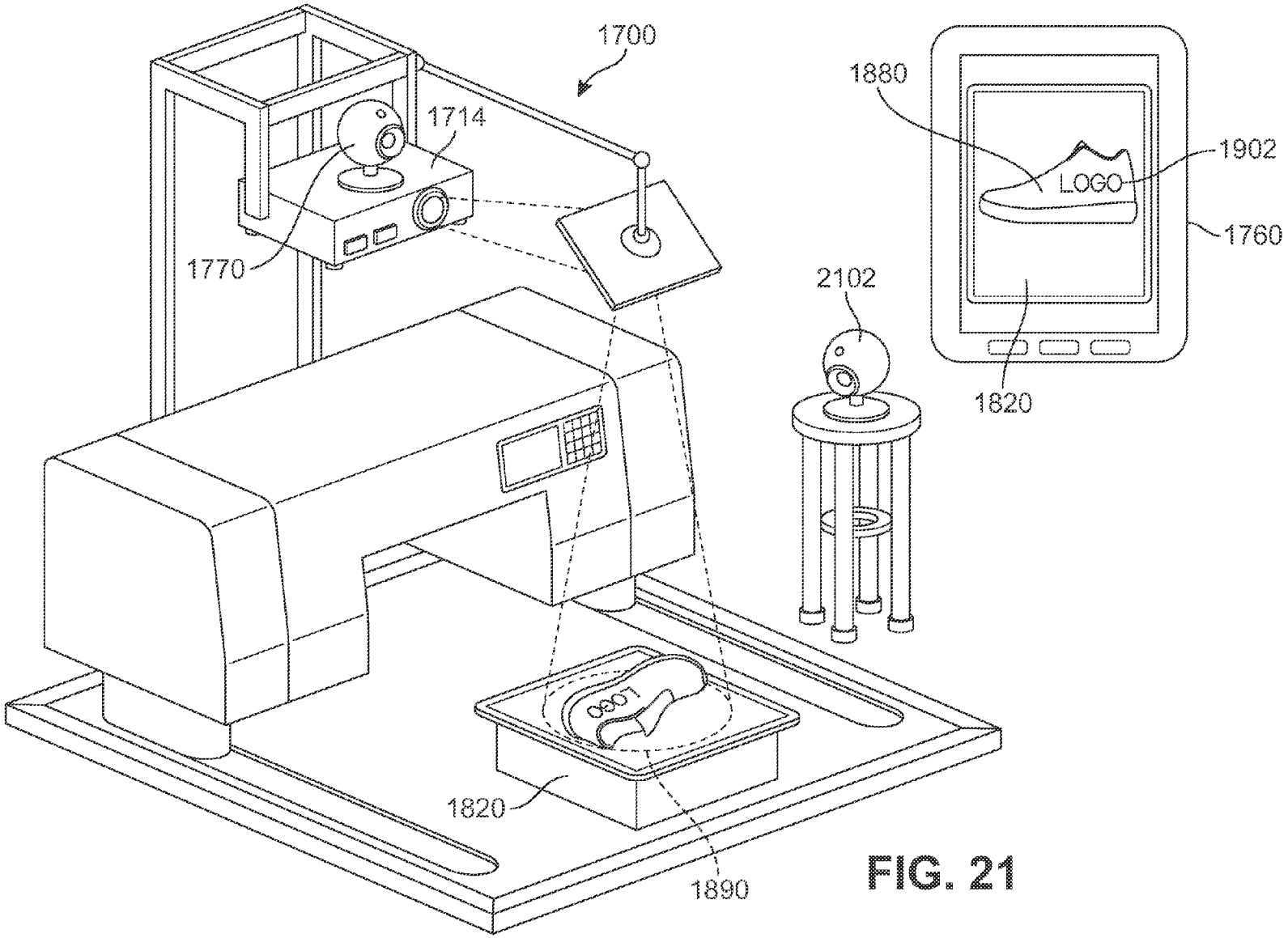
FIG. 21 is a schematic view of another embodiment of a flexible manufacturing system utilizing a second optical device.
Figure 22:
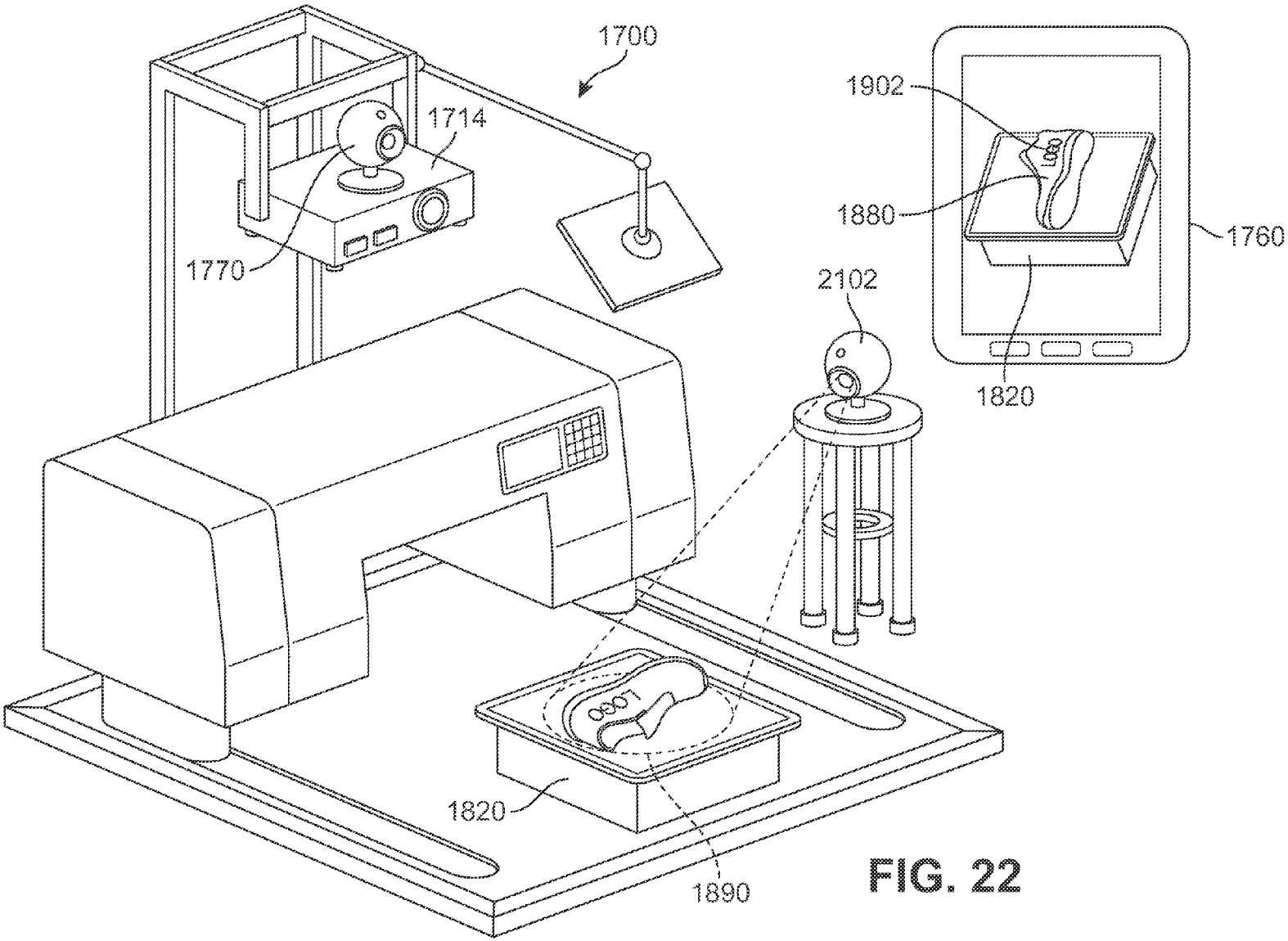
FIG. 22 is a schematic view of the flexible manufacturing system of FIG. 21, in which the view of the projection area seen on a remote device is captured by the second optical device.

Referring next to FIGS. 21 and 22, some embodiments can include provisions for viewing a projection area from two or more different viewing locations. For example, FIG. 21 illustrates an embodiment with an additional optical device 2102 that may serve as a secondary optical device. Switching between the views provided by optical device 1770 (FIG. 21) and optical device 2102 (FIG. 22) could potentially facilitate alignment of a graphic. For example, in situations where some portion of a projection area is obstructed by a first optical device, a second optical device could be used to view the obstructed portions.

In different embodiments, the viewing angle of a projection area provided at a remote device could vary. For example, in one embodiment, the view provided by an optical device could be a substantially top down view. In another embodiment, the viewing angle may be in the approximate range between 35 and 75 degrees from a horizontal plane associated with the projection area. In still other embodiments the viewing angle could be below 35 degrees or greater than 75 degrees. The viewing angle could be selected according to different factors such as user preference, spatial constraints as well as possibly other factors.

As seen in FIGS. 21 and 22, multiple optical devices could be used to achieve multiple different viewing angles from which a user could select. Moreover, in situations where graphics are displayed and printed on contoured surfaces, multiple viewing angles can facilitate alignment of a graphic on an article in three dimensions.

Figure 23:
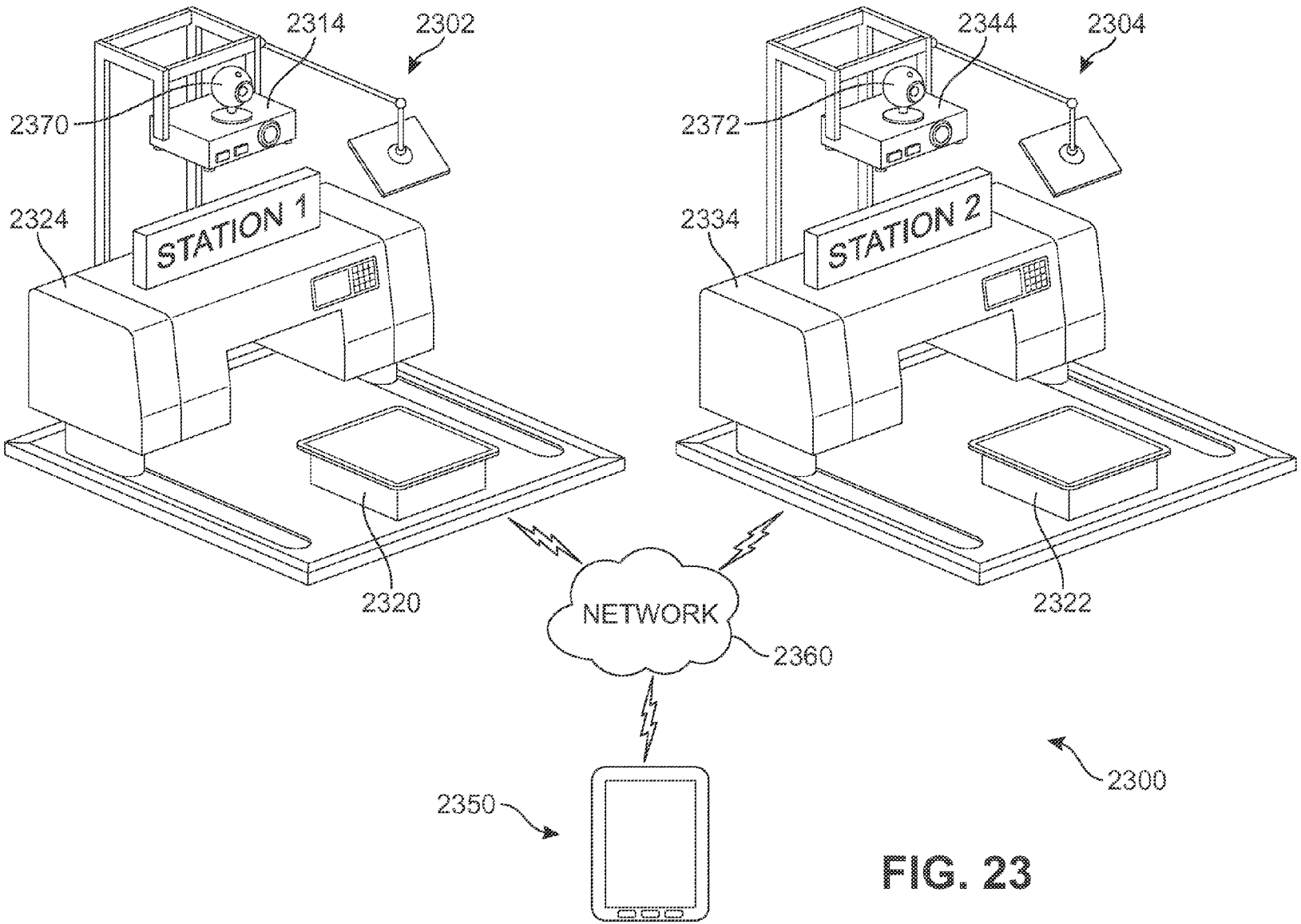
FIG. 23 is a schematic view of a flexible manufacturing system that includes at least two customization stations and a remote device in communication with the two customization stations.

FIG. 23 illustrates a schematic view of an embodiment of a flexible manufacturing system 2300, which includes at least two different customization stations. Referring to FIG. 23, flexible manufacturing system 2300 may include first station 2302 and second station 2304. First flexible manufacturing system 2302 and second flexible manufacturing system 2304 may be configured with similar components to one another. For example, first station 2302 may include printing system 2324, projection system 2314, optical device 2370 and platform 2320. Likewise, second station 2304 may include printing system 2334, projection system 2344, optical device 2372 and platform 2322. Each system can likewise include additional provisions such as those described in earlier embodiments of a flexible manufacturing system.

First station 2302 and second station 2304 may be configured to communicate with remote device 2350 by way of network 2360. In particular, image information captured (or recorded) by optical device 2370 and optical device 2372 may be transmitted to remote device 2350. Also, components of first station 2302 and second station 2304 may be configured to receive information (such as control and/or alignment information) from remote device 2350. With this arrangement, a user of remote device 2350 may be able to adjust the alignment of graphics onto articles at first station 2302 and second station 2304, as discussed below.

Figure 24:
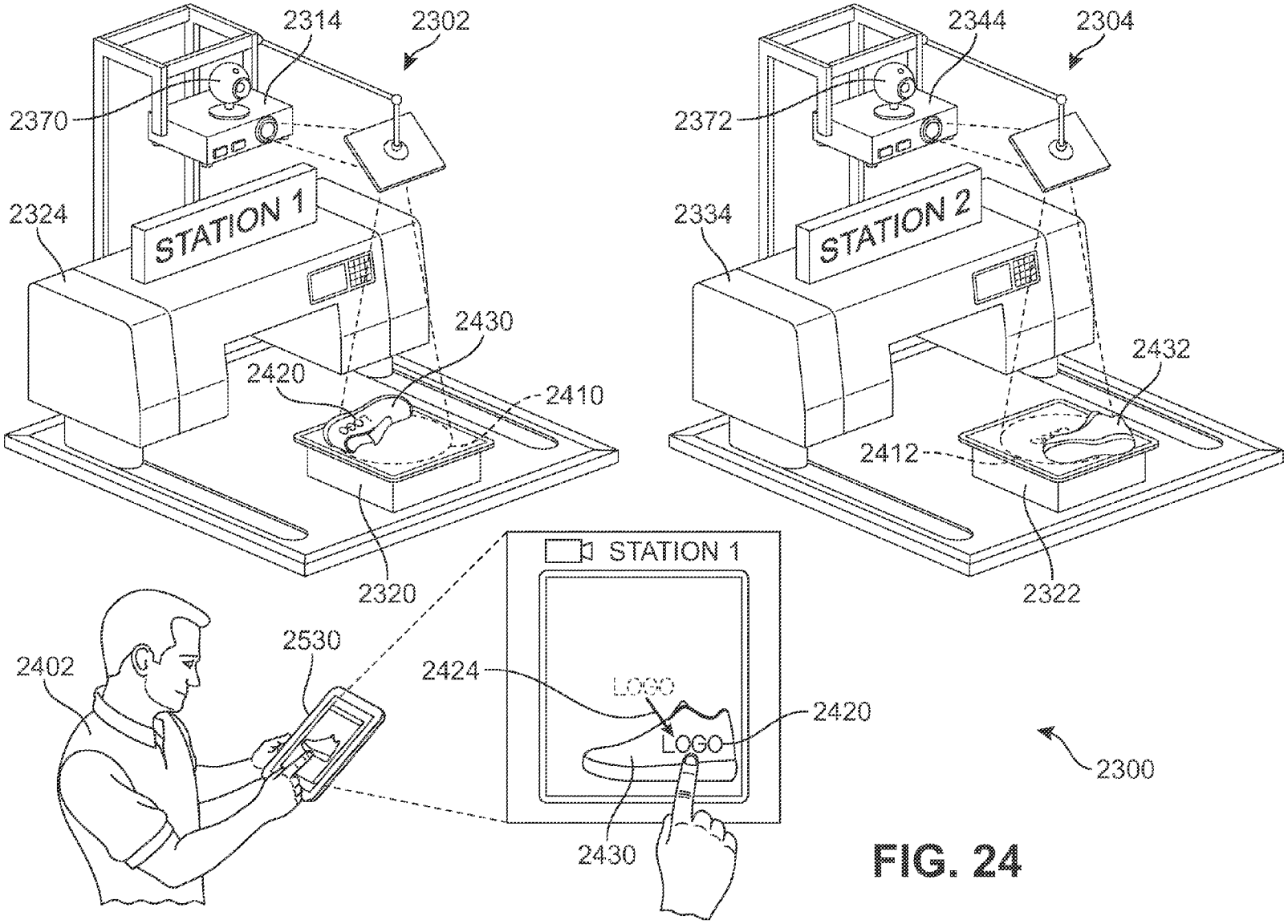
FIG. 24 is a schematic view of the flexible manufacturing system of FIG. 23 in which a user is able to align a graphic on an article at a first station.
Figure 25:
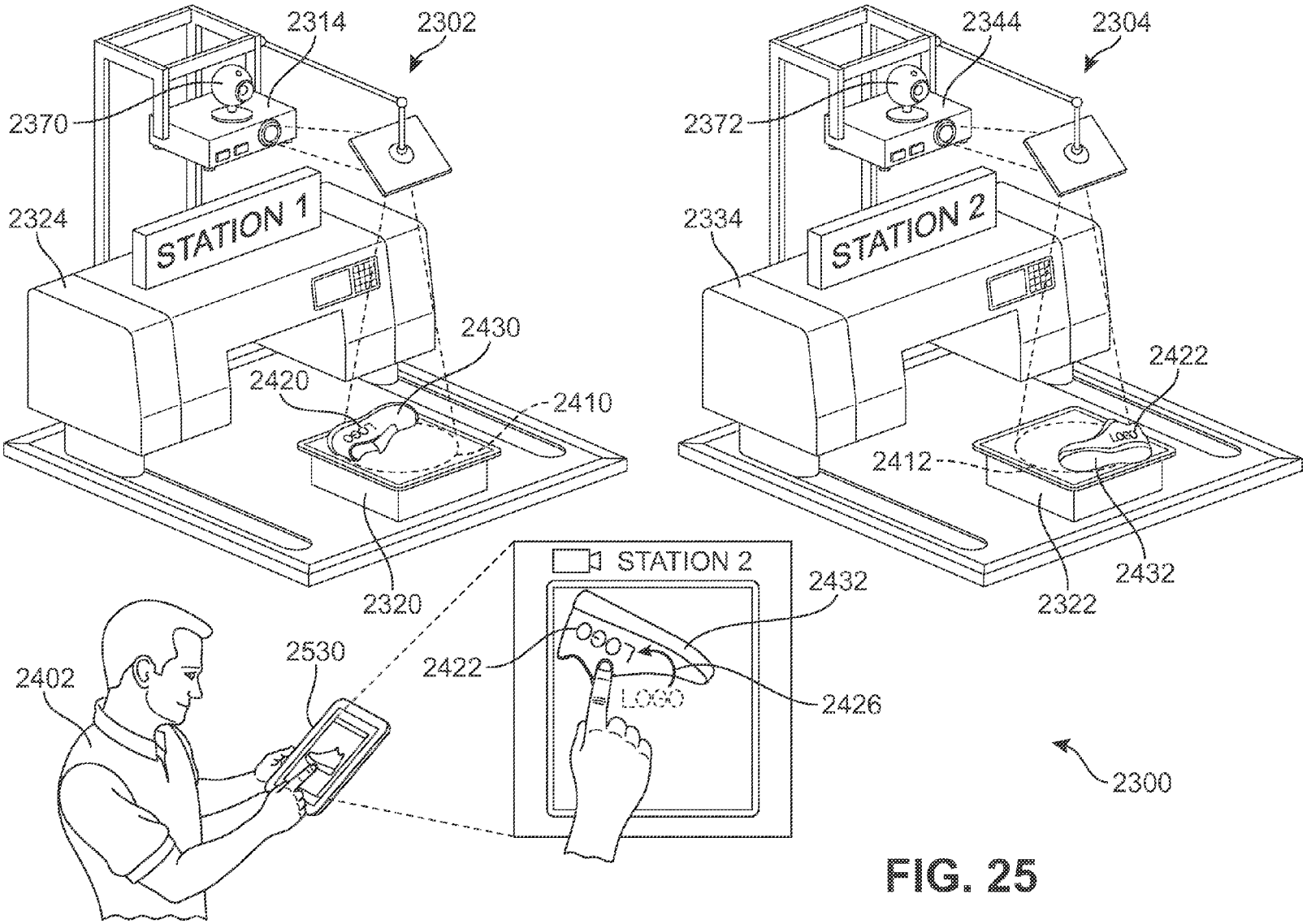
FIG. 25 is a schematic view of the flexible manufacturing system of FIG. 23 in which a user is able to align a graphic on an article at a second station.

FIGS. 24 and 25 illustrate schematic views of a possible method of operating flexible manufacturing system 2300. In this example, a first article 2430 and a second article 2432 have been placed on platforms of first station 2302 and second station 2304, respectively. Referring first to FIG. 24, a user 2402 may operate remote device 2350 in a first mode in which a first projection area 2410 of first station 2302 is visible. This mode could be selected through a navigation menu or toggle button associated with a program running on remote device 2350. With first projection area 2410 visible, user 2402 may align first graphic 2420 at a desired location on first article 2430.

Referring next to FIG. 25, a user may operate remote device 2350 in a second mode in which second projection area 2412 of second station 2304 is visible. In some cases, a button or other input can be used to switch to a view of a second projection area 2412 associated with second station 2304. Due to differences in the initial placement of first article 2430 and second article 2432 on platform 2320 and platform 2322, respectively, user 2402 may make substantially different adjustments in order to achieve the desired alignment of second graphic 2520 with second article 2432. For example, in the case depicted in FIG. 24, user 2402 is able to align first graphic 2420 in the desired location using a single translation (indicated schematically by arrow 2424). In contrast, in the case depicted in FIG. 25, user 2402 must rotate and translate (indicated by arrow 2426) second graphic 2422 to achieve the desired alignment.

The arrangement described here for flexible manufacturing system 2300 allows a user to remotely control the alignment of graphics with articles at two or more stations. It is contemplated that this method could be used with a large number of customization stations, where each station is controlled by a single remote device. Thus, once articles have been laid down at corresponding stations (either by the user or by another worker), a user can control alignment of multiple stations using a single device. This may reduce manufacturing costs and help improve manufacturing efficiency.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A method of printing onto an article, comprising:

positioning the article onto a platform configured to support the article;

associating the article with a projection system so that the platform is in a display ready position, wherein when the platform is in the display ready position, the projection system is configured to project a graphic onto the article;

projecting the graphic onto the article using the projection system;

capturing image information, wherein the image information includes the projected graphic and the article;

displaying the image information on a remote device;

receiving alignment information from the remote device;

adjusting the alignment of the graphic on the article according to the alignment information so that the projected graphic is disposed in a predetermined portion of the article;

moving the platform from the display ready position to a print ready position, wherein when the platform is in the print ready position, a printing system is configured to print the graphic on the article in the predetermined portion of the article; and printing a printed graphic on the article on the predetermined portion of the article.

2. The method according to claim 1, wherein capturing the image information includes recording a real-time video feed of the graphic and the article.

3. The method according to claim 1, wherein the step of moving the platform is carried out manually.

4. The method according to claim 1, wherein a computer system associated with the platform moves the platform automatically.

5. The method according to claim 1, wherein associating the article with the projection system includes placing the article in an optical path of light projected by the projection system.

6. The method according to claim 1, wherein adjusting the alignment of the graphic includes translating and rotating the graphic.

7. A flexible manufacturing system for an article, comprising:

a printing system;

a projection system that is calibrated with the printing system, where the projection system can be used to align a graphic that is to be printed onto the article by the printing system;

a platform for supporting the article, wherein the platform is configured to move between a display ready position and a print ready system, wherein when the platform is in the display ready position, the platform is disposed within an optical path of light projected by the projection system, and wherein when the platform is in the print ready position, the platform is removed from the optical path of light projected by the projection system;

a projection area for receiving a projected graphic that is projected onto the article by the projection system;

an optical device for capturing image information associated with the projection area, wherein the image information includes the projected graphic and the article;

a remote device configured to display the captured image information; and wherein the remote device can be used to control the alignment of the graphic within the projection area.

8. The flexible manufacturing system according to claim 7, wherein the optical device is a video camera.

9. The flexible manufacturing system according to claim 7, wherein the optical device is disposed adjacent to the projection system.

10. The flexible manufacturing system according to claim 7, wherein the optical device is disposed away from the projection system.

11. The flexible manufacturing system according to claim 7, wherein the remote device is a computer.

12. The flexible manufacturing system according to claim 11, wherein the remote device is a tablet computer.

13. The flexible manufacturing system according to claim 7, wherein the position and orientation of the graphic can be adjusted.

14. A flexible manufacturing system, comprising:

a first station including:

a first printing system, and a first projection system, and a first optical device for capturing first image information, where the first projection system is calibrated with the first printing system so as to assist with printing alignment;

a first projection area for projecting a first graphic onto a first article using the first projection system, wherein the first image information is associated with the first projection area and includes the first projected graphic and the first article;

a first platform for supporting the first article, wherein the first platform is configured to move between a display ready position and a print ready system, wherein when the first platform is in the display ready position, the first platform is disposed within an optical path of light projected by the first projection system, and wherein when the first platform is in the print ready position, the first platform is removed from the optical path of light projected by the first projection system;

a second station including:

a second printing system, and a second projection system, and a second optical device for capturing second image information, wherein the second projection system is calibrated with the second printing system so as to assist with printing alignment;

a second projection area for projecting a second graphic onto a second article using the second projection system, wherein the second image information is associated with the second projection area and includes the second projected graphic and the second article;

a second platform for supporting the second article, wherein the second platform is configured to move between a display ready position and a print ready system, wherein when the second platform is in the display ready position, the second platform is disposed within the optical path of light projected by the second projection system, and wherein when the second platform is in the print ready position, the platform is removed from an optical path of light projected by the second projection system and associated with the second printing system;

a remote device configured to receive:

the captured first image information;

the captured second image information; and wherein the remote device can be used to control the alignment of the first graphic on the first article and wherein the remote device can be used to control the alignment of the second graphic on the second article.

15. The flexible manufacturing system according to claim 14, wherein the first optical device is disposed away from the first projection system.

16. The flexible manufacturing system according to claim 14, wherein the second optical device is disposed away from the second projection system.

17. The flexible manufacturing system according to claim 14, wherein the remote device includes a first mode where the remote device displays a video feed of the first projection area and wherein the remote device includes a second mode where the remote device displays a video feed of the second projection area.

18. The flexible manufacturing system according to claim 14, wherein the remote device is a portable device.

19. The flexible manufacturing system according to claim 14, wherein the first article is disposed on the first platform of the first station and the second article is disposed on the second platform of the second station and wherein the position of the first article relative to the first platform is substantially different from the position of the second article relative to the second platform.

20. The flexible manufacturing system according to claim 14, wherein the first image information is a first video feed and wherein the second image information is a second video feed.

* * * * *